US012668912B2

(12) United States Patent
Kim et al.

(10) Patent No.: US 12,668,912 B2
(45) Date of Patent: Jun. 30, 2026

(54) LAUNDRY TREATING APPARATUS

(71) Applicant: LG ELECTRONICS INC., Seoul (KR)

(72) Inventors: Woore Kim, Seoul (KR); Dongkil Choi, Seoul (KR); Injae Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 92 days.

(21) Appl. No.: 18/714,966

(22) PCT Filed: Nov. 30, 2022

(86) PCT No.: PCT/KR2022/019194
§ 371 (c)(1),
(2) Date: May 30, 2024

(87) PCT Pub. No.: WO2023/101410
PCT Pub. Date: Jun. 8, 2023

(65) Prior Publication Data

US 2025/0027255 A1 Jan. 23, 2025

(30) Foreign Application Priority Data

Nov. 30, 2021 (KR) ..... 10-2021-0168423

(51) Int. Cl.
*D06F 39/04* (2006.01)
*D06F 37/04* (2006.01)
*D06F 37/26* (2006.01)

(52) U.S. Cl.
CPC ..... *D06F 39/04* (2013.01); *D06F 37/04* (2013.01); *D06F 37/267* (2013.01)

(58) Field of Classification Search
CPC ..... D06F 39/04
See application file for complete search history.

(56) References Cited

U.S. PATENT DOCUMENTS

2015/0354123 A1 12/2015 Kim et al.
2020/0048816 A1 2/2020 Kim et al.
2020/0048819 A1 2/2020 Lee et al.

FOREIGN PATENT DOCUMENTS

KR 10-2019-0016866 A 2/2019
KR 10-2021-0111179 A 9/2021

*Primary Examiner* — Jason Y Ko
(74) *Attorney, Agent, or Firm* — Birch, Stewart, Kolasch & Birch, LLP

(57) ABSTRACT

A laundry treating apparatus includes a cabinet including an inlet, a tub disposed inside the cabinet, the tub being configured to hold water, a drum disposed inside the tub, the drum including a conductive material and being configured to rotate, a driver including a rotation shaft, the driver being disposed at a rear of the tub and being configured to rotate the drum, and an induction module coupled to an outer circumferential surface of the tub, the induction module being configured to generate a magnetic field for heating the drum. Also, the tub includes a mounting surface, the induction module is mounted on the mounting surface or the induction module overlaps with the mounting surface, and the mounting surface is a flat surface, or a radius of curvature of the mounting surface is greater than a radius of curvature of the tub.

20 Claims, 11 Drawing Sheets

(a)

(b)

[Fig. 1]
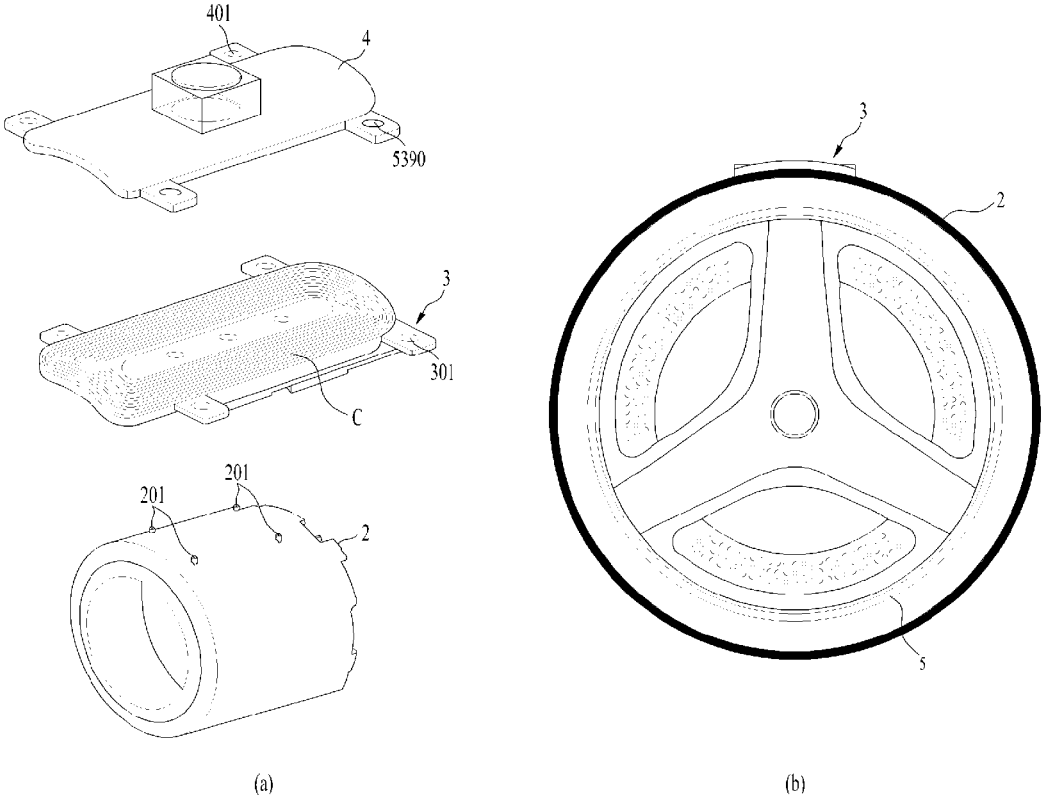

[Fig. 2]
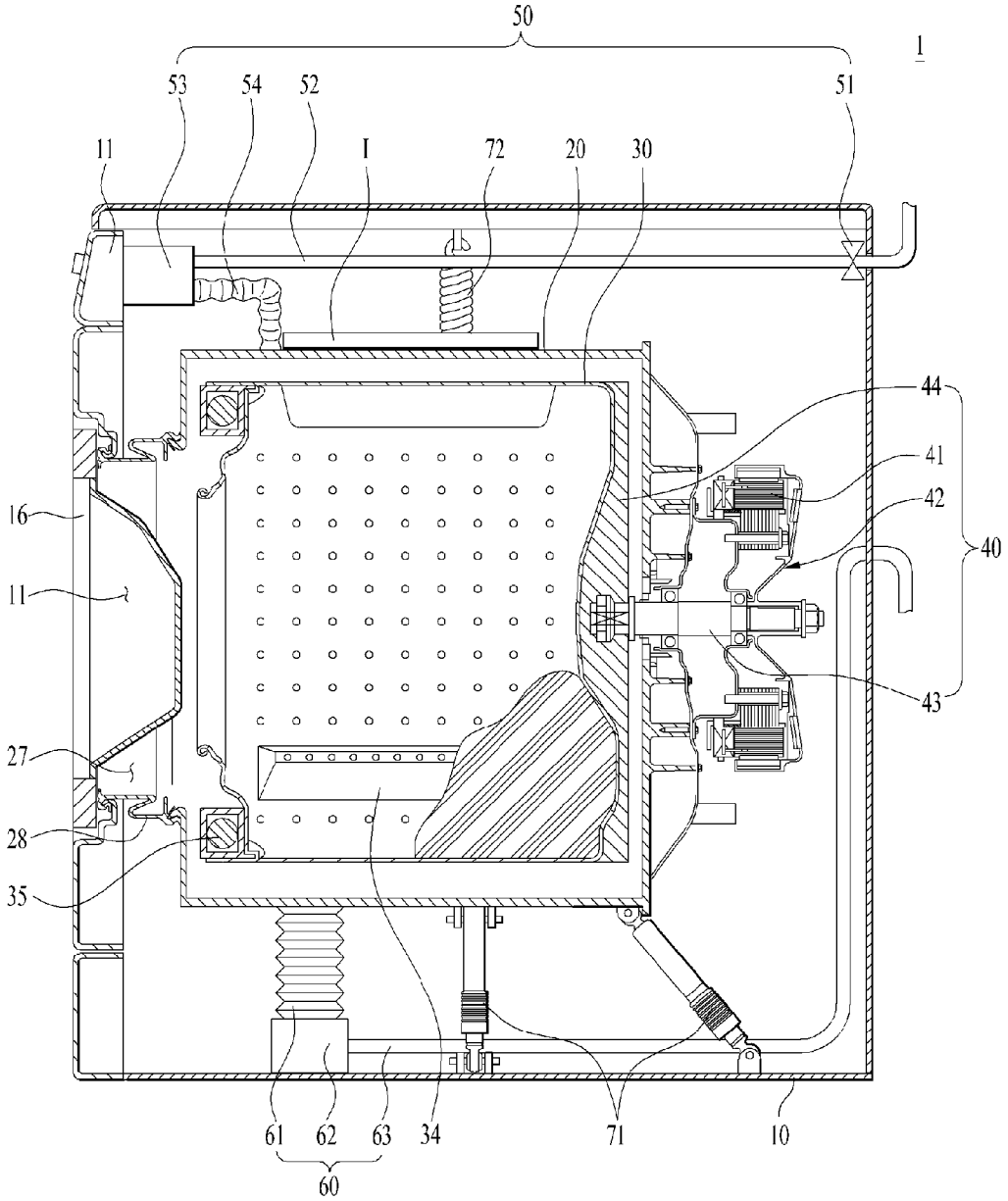

[Fig. 3]
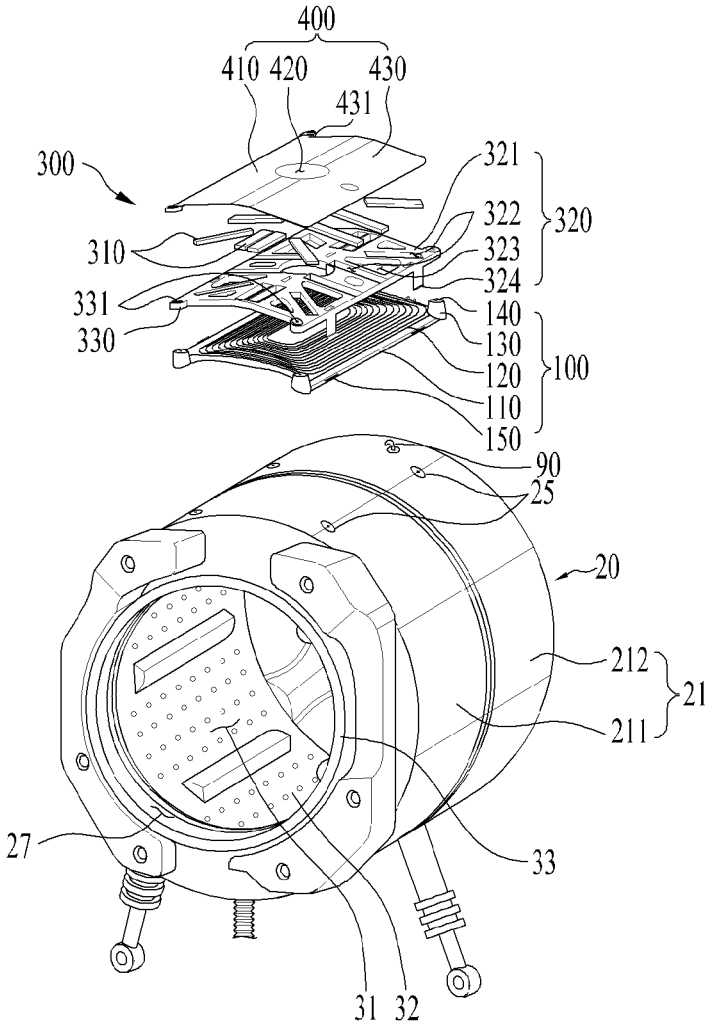

[Fig. 4]
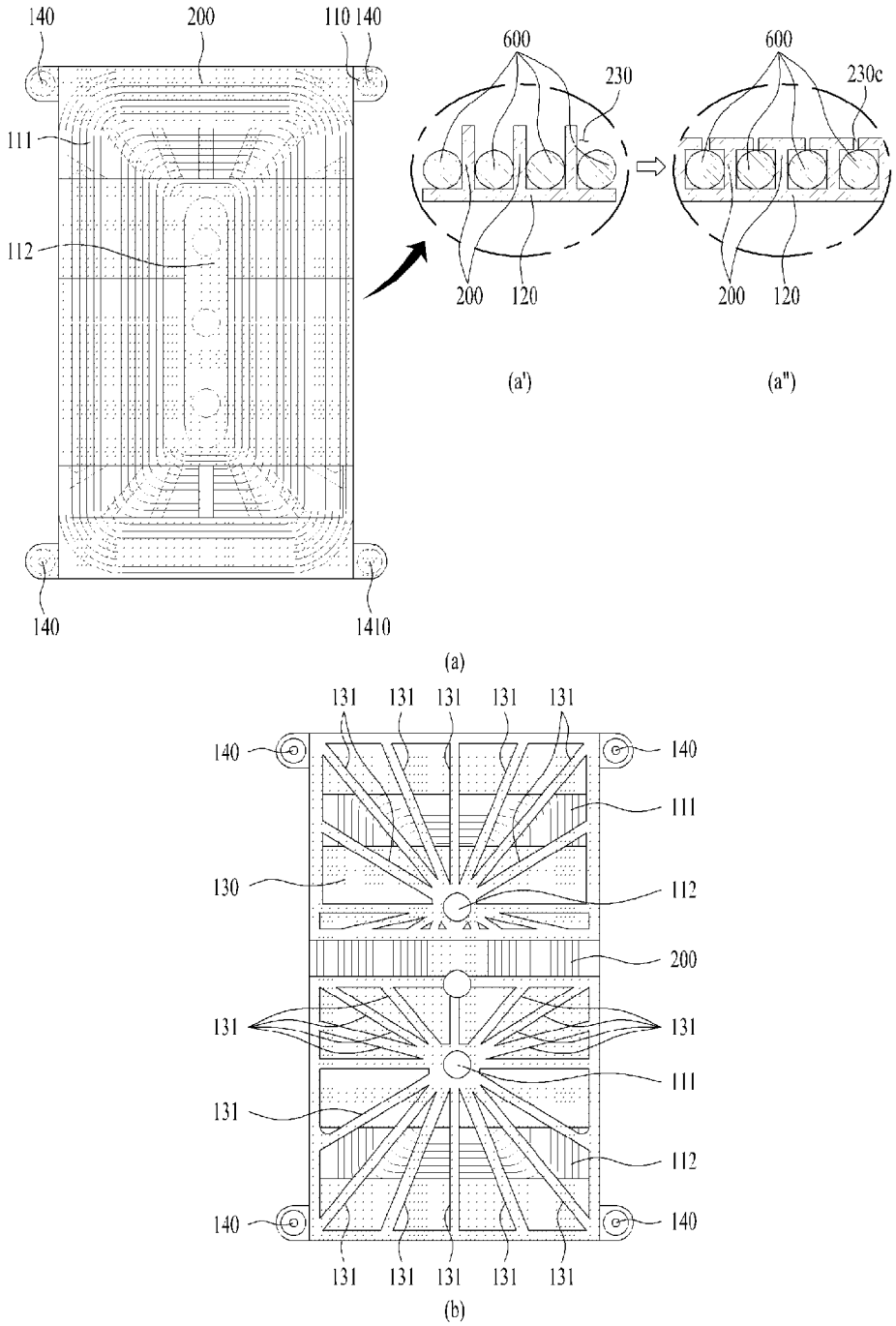

[Fig. 5]
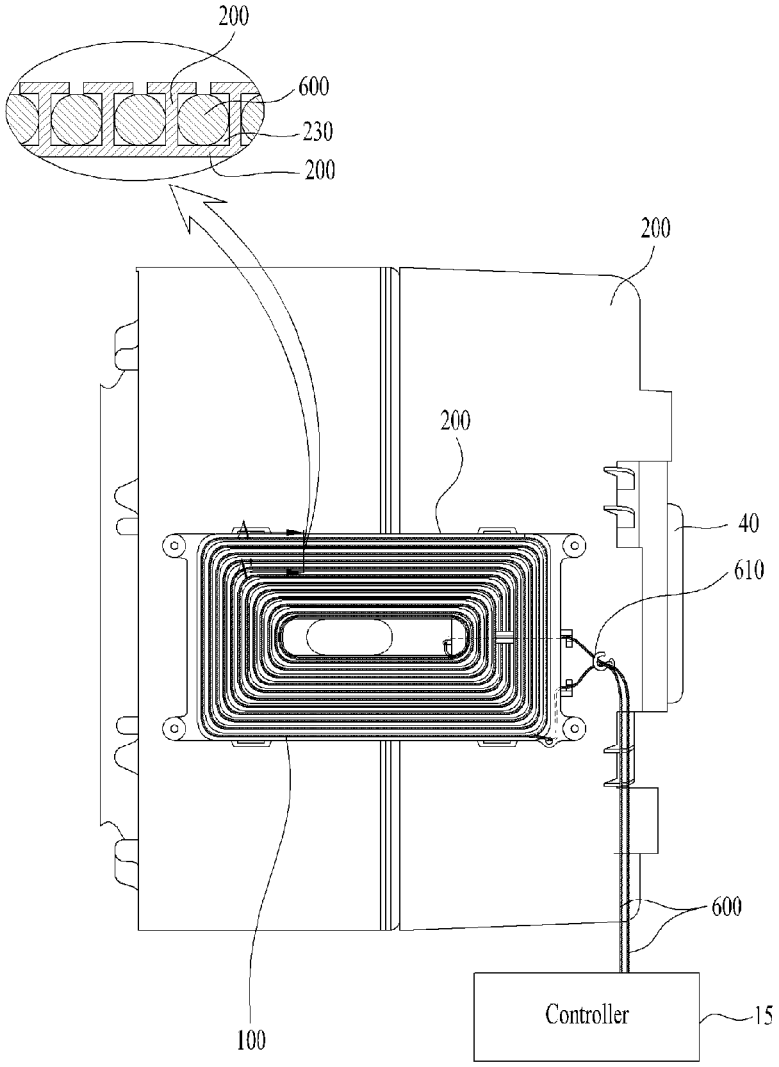

[Fig. 6]
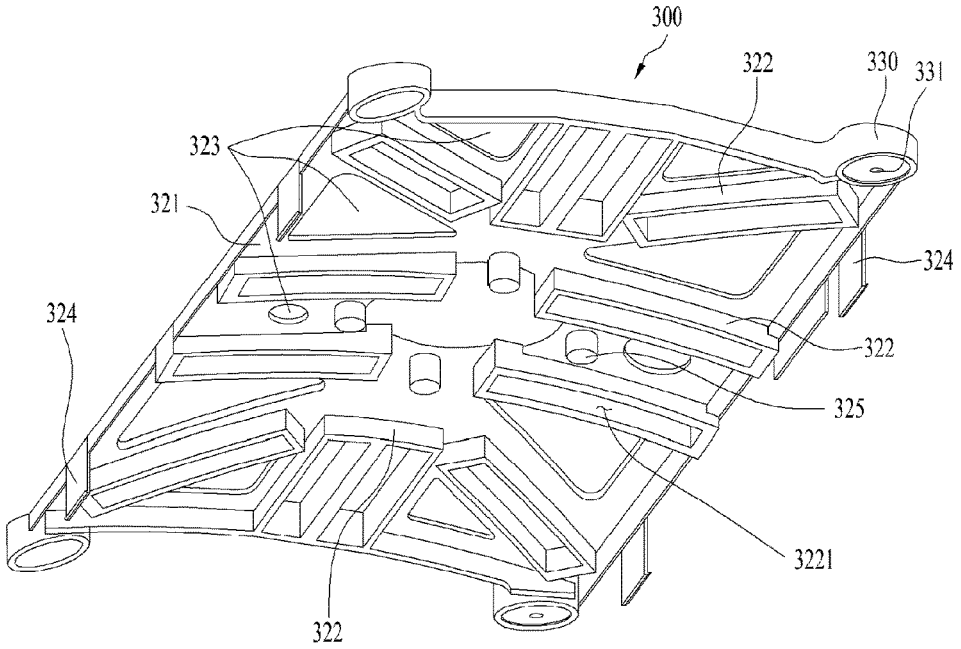
[Fig. 7]
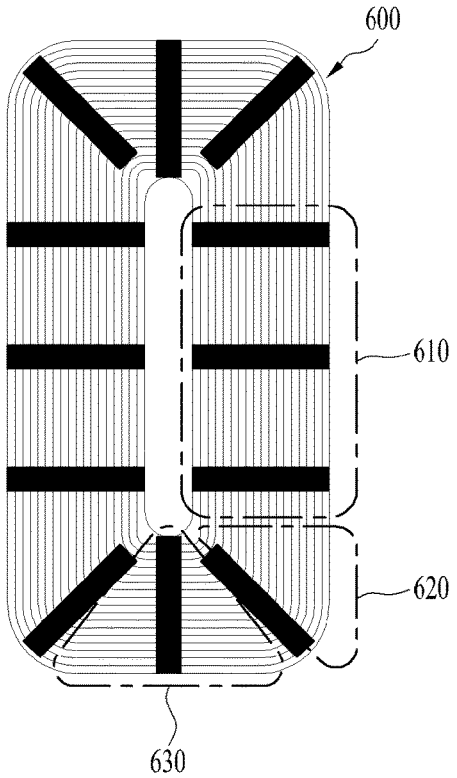

[Fig. 8]
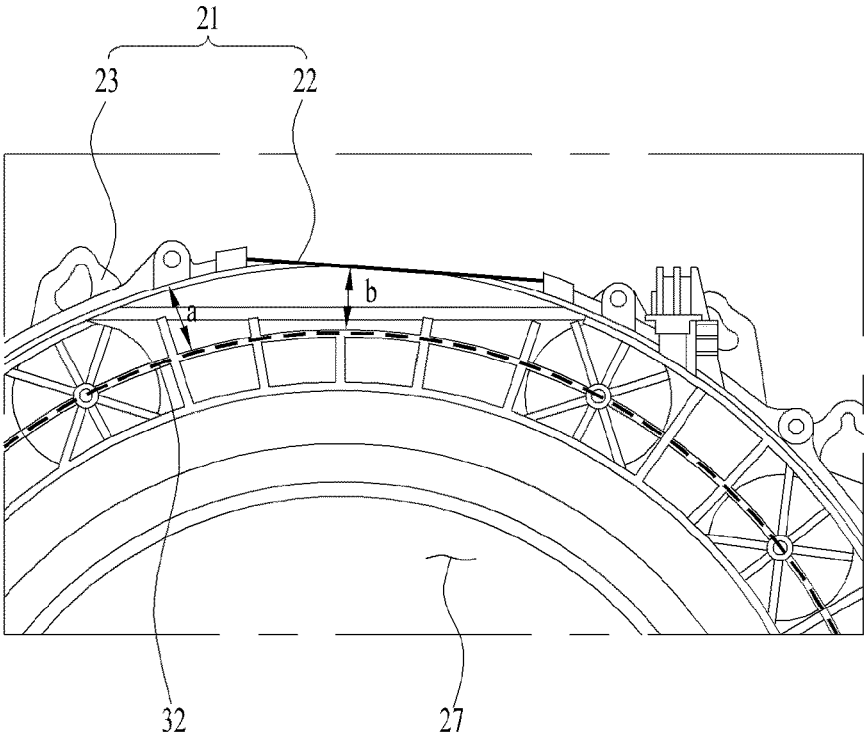
[Fig. 9]
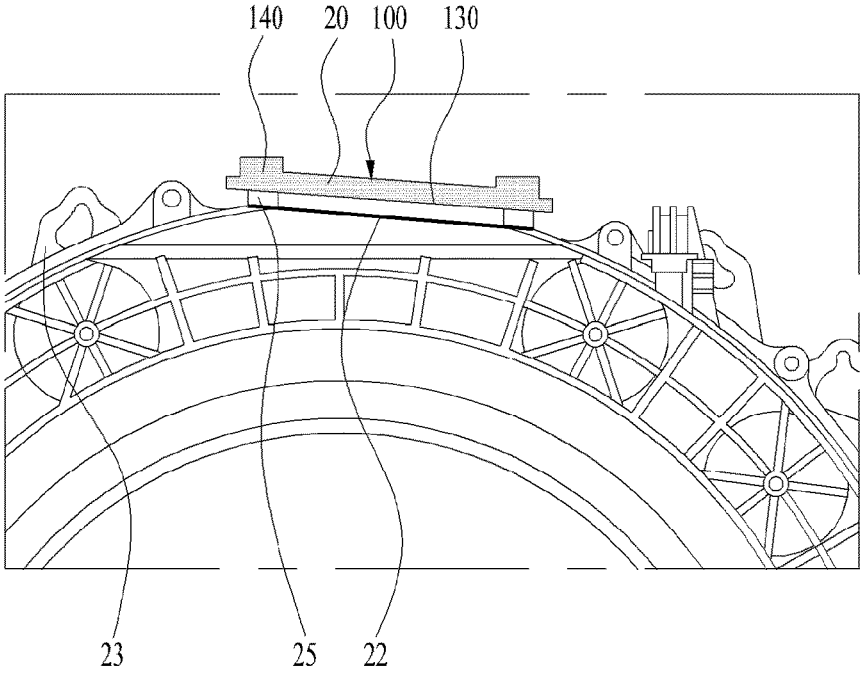

[Fig. 10]
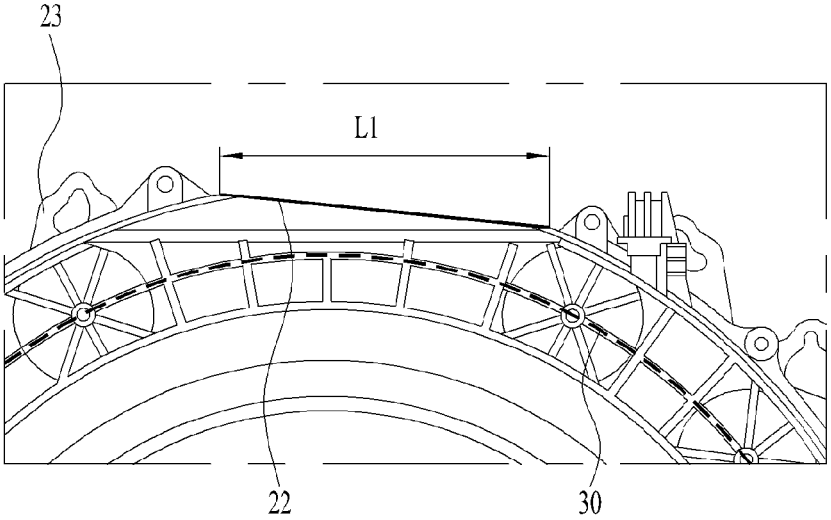
(a)
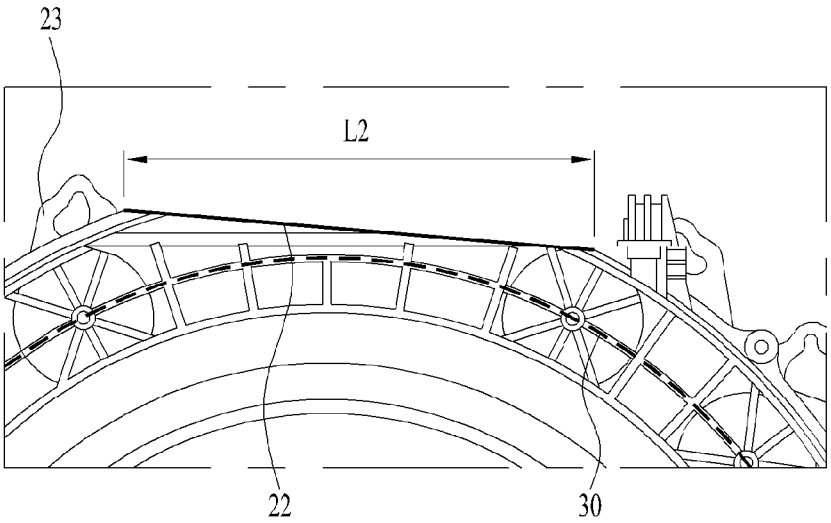
(b)

[Fig. 11]
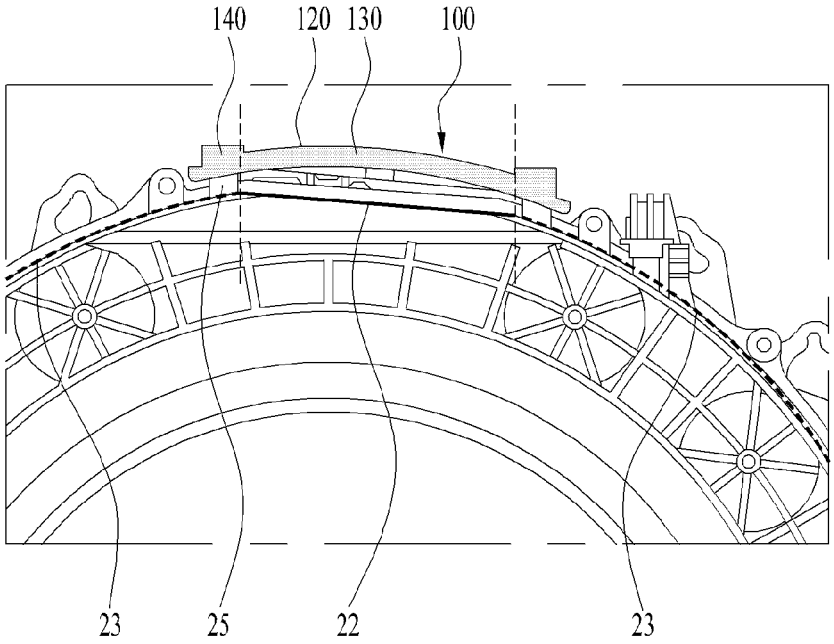
[Fig. 12]
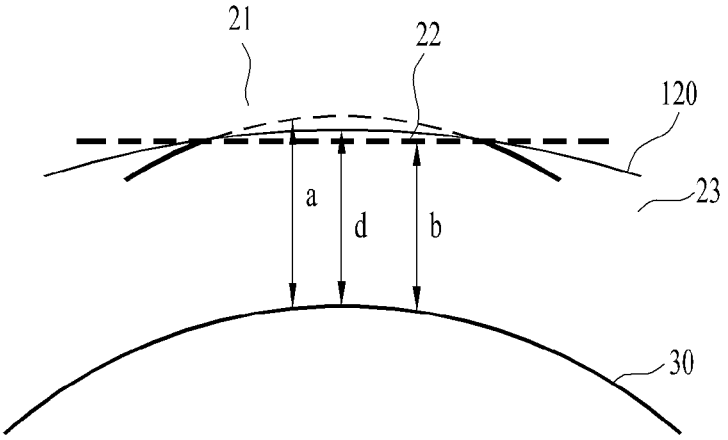

[Fig. 13]
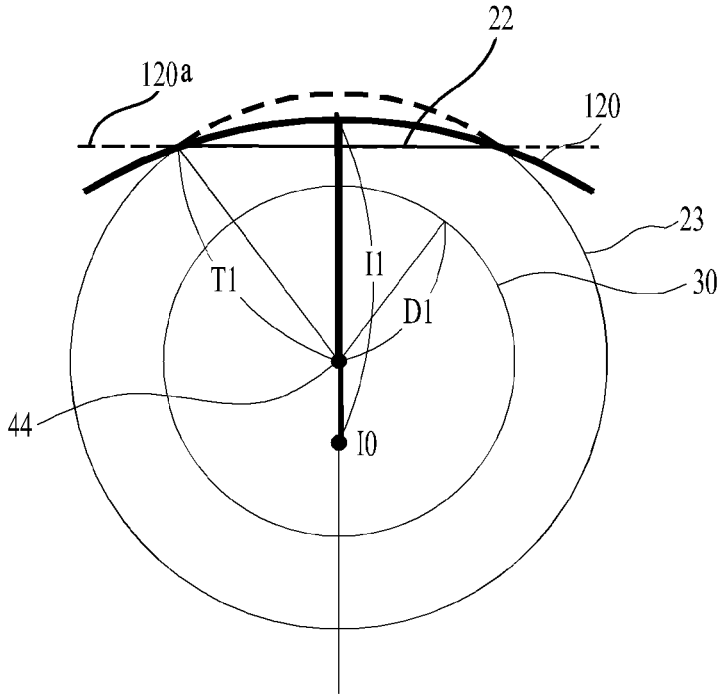
[Fig. 14]
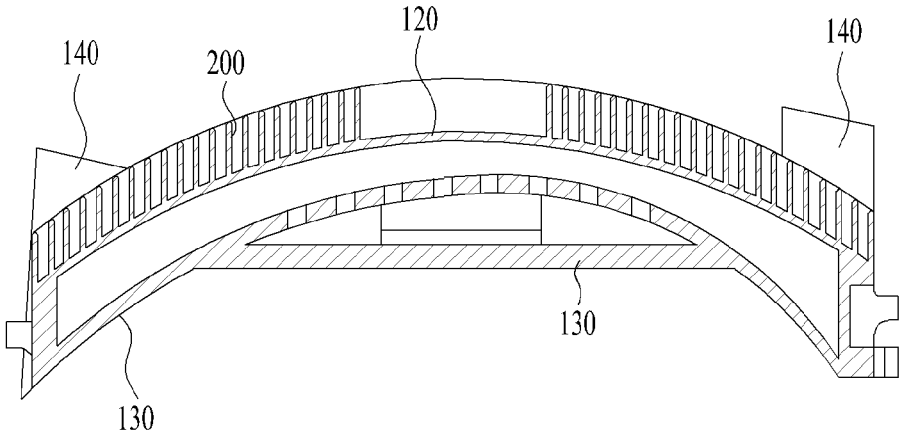

【FIG 15】
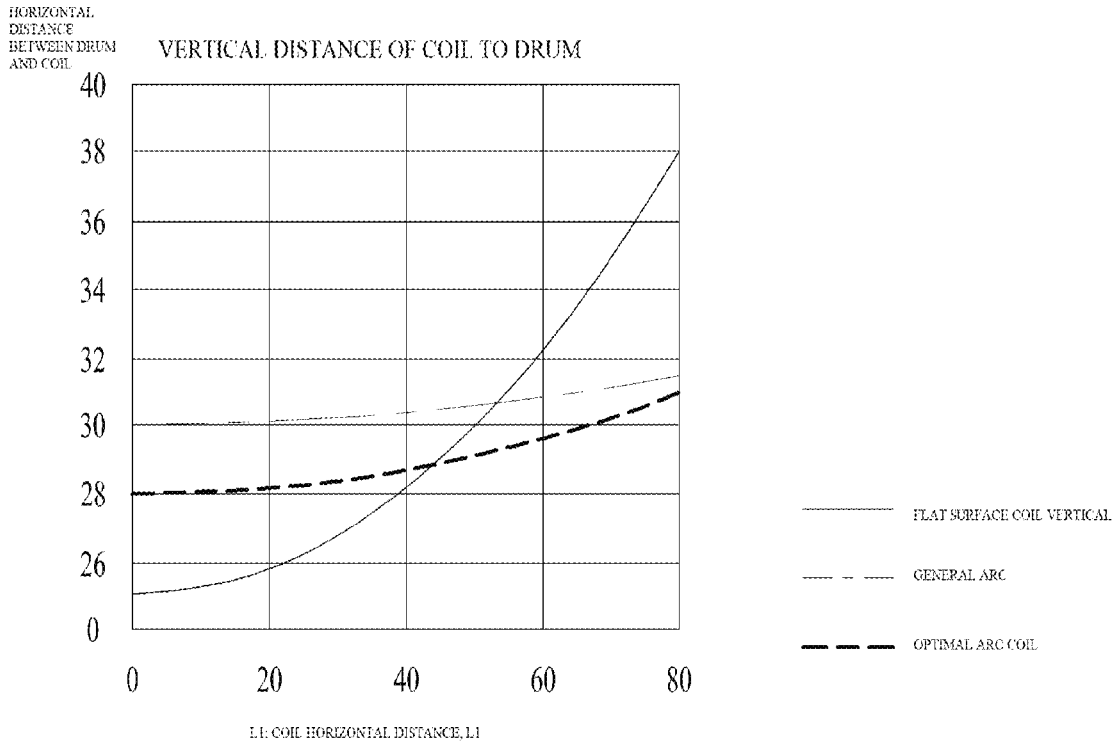
【FIG 16】
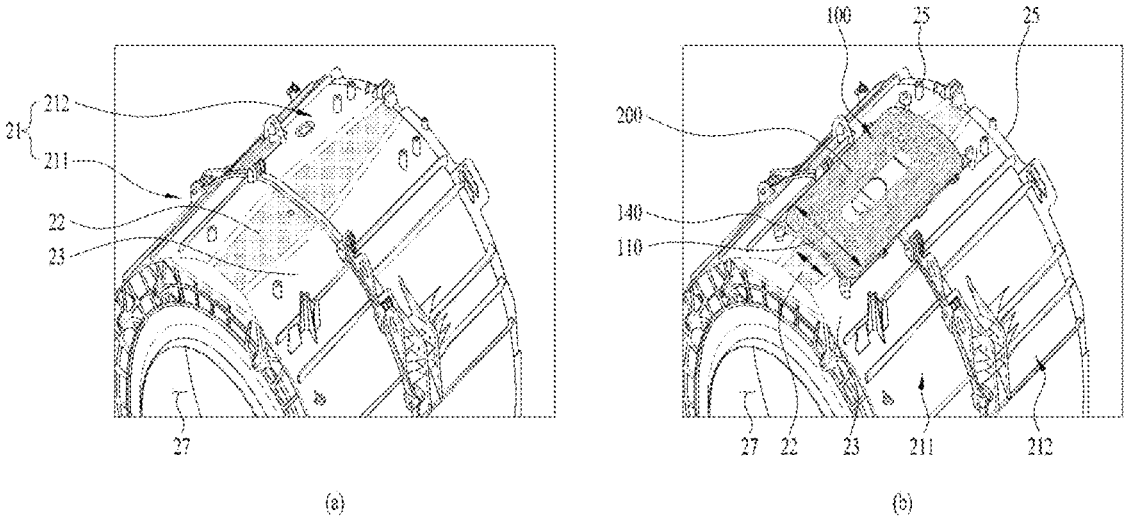

LAUNDRY TREATING APPARATUS

CROSS REFERENCE TO RELATED APPLICATIONS

This application is a National Phase application under 35 U.S.C. 371 of International Application No. PCT/KR2022/019194, filed on Nov. 30, 2022, which claims priority to Korean Application No. 10-2021-0168423, filed on Nov. 30, 2021, the entireties of all these applications are incorporated by reference herein into the present application.

BACKGROUND

1. Technical Field

The present disclosure relates to a laundry treating apparatus.

2. Discussion of the Related Art

In general, laundry treating apparatuses include various types of laundry treating apparatuses, such as a washing machine with a main purpose of laundry washing, a washing machine with a main purpose of drying, and a refresher with a main purpose of refreshing.

In the laundry treating apparatus, the washing refers to a process of removing contaminants from clothes by adding water and detergent and using a mechanical action, and the drying refers to a process of removing moisture contained in wet laundry.

A laundry treating apparatus can be configured to heat the laundry or water in order to increase a washing efficiency or dry the laundry.

In a related art example laundry treating apparatus, a heater is directly inserted into a tub for accommodating water therein to heat water, or the laundry and water are heated in a scheme of supplying hot air into a drum that holds the laundry therein.

However, because the scheme of heating water with the heater should satisfy a condition that the heater should always be submerged in the water, there is a fundamental limitation that the laundry is not able to be heated when there is no water.

In addition, the scheme of supplying hot air to the drum has a problem in that the configuration becomes rather complicated because a duct through which the hot air is circulated or supplied, a heat pump system that separately heats the air in the duct, and the like should be installed, and has a fundamental limitation that the laundry or water is not able to be heated with the hot air when water is inside the drum.

In order to solve such problem, recently, a laundry treating apparatus that directly heats a drum made of metal via an induced current has appeared (see Korean Patent Publication Application No. 10-2019-0016866).

FIG. 1, including parts (a) and (b), shows a related art example laundry treating apparatus that directly heats a drum via an induced current.

Referring to part (a) in FIG. 1, the related art example laundry treating apparatus may include a tub 2 for accommodating a drum made of metal therein, an induction module 3 coupled to the tub to generate an induced current in the drum, and a cover 4 for fixing the induction module 3 to the tub 2.

The induction module 3 may generate an induced magnetic field to generate an eddy current in the drum, and heat the drum itself as the eddy current generated in the drum is converted into thermal energy.

Accordingly, the related art example laundry treating apparatus may dry the laundry or heat water by heating the drum as needed, regardless of whether the drum includes water or not.

The induction module 3 was able to be coupled to and fixed to the tub 2. Because the tub 2 is made of a plastic material, the magnetic field generated by the induction module 3 was able to be transmitted to the drum as it is.

Referring to part (b) in FIG. 1, the closer the induction module 3 is to the drum 5, a larger amount of induced current is able to be generated in the drum 5. Therefore, it may be more advantageous to couple the induction module 3 to an inner circumferential surface of the tub 2, rather than coupling the induction module 3 to an outer circumferential surface of the tub 2.

However, water is accommodated inside the tub 2, so that, when the drum 5 rotates, the water may be dissipated to an upper outer circumferential surface of the tub 2 due to a centrifugal force, and a short circuit or the like may occur in the induction module 3, which is vulnerable to moisture. In addition, when eccentricity occurs inside the drum 5 and vibration increases, there is a possibility that the drum 5 may collide with the induction module 3 while rotating. Therefore, the induction module 3 may be coupled to the outer circumferential surface of the tub 2.

Therefore, the induction module 3 should come into close contact with the outer circumferential surface of the tub 2 in order to be disposed as close to the drum 5 as possible. As a result, in the related art example laundry treating apparatus, research has been focused on forming a bottom surface of the induction module 3 having a radius of curvature that is similar as possible to the outer circumferential surface of the tub 2.

Accordingly, the induction module 3 is in surface contact with the tub 2 as much as possible, so that a spacing between the induction module 3 and the drum 5 was able to reach a spacing between the tub 2 and the drum 5.

However, because a top surface of the induction module 3 has a slightly greater radius of curvature than a bottom surface thereof and a coil for generating the induced current in the drum 5 is seated and wound on the induction module 3, there are problems in that a radius of curvature of the coil is greater than the radius of curvature of the tub 2, and an average spacing between the coil and the drum 5 is inevitably greater than the spacing between the tub 2 and the drum 5.

Therefore, the coil protrudes farther away from the drum 5 in an outward direction from a center of the induction module 3, resulting in lower efficiency than when the coil has the same radius of curvature as the drum 5.

For this reason, the induction module of the related art example laundry treating apparatus has a problem of a large energy loss when heating the drum 5 with the coil.

SUMMARY OF THE DISCLOSURE

An object of the present disclosure is to provide a laundry treating apparatus in which an average spacing between a drum and a coil that is disposed outside a tub and is able to generate an induced current in the drum may be smaller than a spacing between the tub and the drum.

Another object of the present disclosure is to provide a laundry treating apparatus capable of narrowing the spacing between the coil and the drum by changing a shape of a tub outer circumferential surface on which an induction module equipped with the coil is seated.

An object of the present disclosure is to provide a laundry treating apparatus capable of increasing a heating performance by maximizing the generation of the induced current in the drum even when the induction module is coupled to the tub from the outside.

In order to reduce a spacing between a drum and an induction module coupled to a tub outer circumferential surface, the present disclosure may form the tub outer circumferential surface to which the induction module is coupled as a flat surface.

In order to ensure a heating performance, the induction module may be coupled to the flat surface formed on the tub outer circumferential surface, and may have a width greater than a width of the flat surface. In this situation, the induction module may have a greater radius of curvature than the outer circumferential surface of the tub to be more closely in contact with the outer circumferential surface of the tub, and may become closer to the drum.

A tub body forming an outer appearance of the tub may include a mounting surface, in which the induction module is mounted on the mounting surface or the mounting surface faces the induction module, and a circumferential surface extending from the mounting surface to form the outer circumferential surface of the tub body.

The mounting surface may be disposed closer to the drum than the circumferential surface.

A spacing from the mounting surface to the drum may be smaller than a spacing from the circumferential surface to the drum.

A distance from the rotation shaft to the mounting surface may be smaller than a distance from the rotation shaft to the circumferential surface.

The mounting surface may extend as a flat surface from the circumferential surface or may extend such that a radius of curvature thereof is greater than a radius of curvature of the circumferential surface.

The mounting surface of the outer circumferential surface of the tub body may be disposed upwardly of the rotation shaft.

The induction module may include a base where a coil for generating the magnetic field is wound and seated, and a coupling portion extending from the base and fixed to the tub body, and a width of the base may be greater than a width of the mounting surface.

A radius of curvature of the base may be greater than the radius of curvature of the tub body.

A radius of curvature of the base may be smaller than the radius of curvature of the mounting surface.

The base may be disposed spaced apart from the mounting surface.

The base may include a seating surface formed at a top surface of the base, in which the coil is seated on the seating surface, and a bottom surface facing the mounting surface, and a radius of curvature of the seating surface may be greater than the radius of curvature of the tub body.

The bottom surface may have a radius of curvature different from the radius of curvature of the seating surface.

The bottom surface may have a greater radius of curvature than the seating surface or may be formed as a flat surface.

A radius of curvature of the seating surface may be constant over a width thereof.

The coupling portions may be coupled to portions of the circumferential surface extending from both sides of the mounting surface.

A length of the base may be smaller than a length of the mounting surface.

An area of the induction module may be greater than an area of the mounting surface.

The tub body may be formed such that a diameter thereof increases and then decreases in a rearward direction, and the mounting surface may be formed such that a spacing from the drum is constant from a front end to a rear end thereof.

The mounting surface may be formed such that a width thereof increases and then decreases in the rearward direction.

The present disclosure may allow the average spacing between the drum and the coil that is disposed outside the tub and is able to generate the induced current in the drum to be smaller than the spacing between the tub and the drum.

The present disclosure may narrow the average spacing between the coil and the drum.

The present disclosure may increase the heating performance by maximizing the generation of the induced current in the drum even when the induction module is coupled to the tub from the outside.

BRIEF DESCRIPTION OF THE DRAWINGS

The above and other objects, features, and advantages of the present disclosure will become more apparent to those of ordinary skill in the art by describing example embodiments thereof in detail with reference to the attached drawings, which are briefly described below.

FIG. 1, including parts (a) and (b), shows an induction arrangement of a related art example laundry treating apparatus.

FIG. 2 shows a structure of a laundry treating apparatus according to an embodiment of the present disclosure.

FIG. 3 shows an induction module of a laundry treating apparatus according to an embodiment of the present disclosure.

FIG. 4, including parts (a), (a'), (a") and (b), shows a base structure of an induction module according to an embodiment of the present disclosure.

FIG. 5 shows a structure in which a coil is wound in an induction module according to an embodiment of the present disclosure.

FIG. 6 shows a structure for installing permanent magnets in an induction module according to an embodiment of the present disclosure.

FIG. 7 shows a coil structure of an induction module according to an embodiment of the present disclosure.

FIG. 8 shows a region in which an induction module may be installed in a laundry treating apparatus according to an embodiment of the present disclosure.

FIG. 9 shows an induction module of a laundry treating apparatus according to an embodiment of the present disclosure.

FIG. 10, including parts (a) and (b), shows a flat surface installation limit of a tub of a laundry treating apparatus according to an embodiment of the present disclosure.

FIG. 11 shows that an induction module of a laundry treating apparatus according to an embodiment of the present disclosure is larger than a planar structure disposed on a tub.

FIG. 12 shows an example shape of the induction module according to an embodiment of the present disclosure.

FIG. 13 shows a principle of a shape of the induction module according to an embodiment of the present disclosure.

FIG. 14 shows the induction module according to another embodiment of the present disclosure.

FIG. 15 shows an example shape of the induction module according to an embodiment of the present disclosure.

FIG. 16, including parts (a) and (b), shows a laundry treating apparatus according to another embodiment of the present disclosure.

DETAILED DESCRIPTION OF THE EMBODIMENTS

Hereinafter, embodiments disclosed herein will be described in detail with reference to the accompanying drawings. Herein, the same or similar reference numerals are assigned to the same or similar components even in different embodiments, and a description of the same or similar components is replaced with the first description. Singular expressions used herein include plural expressions unless the context clearly dictates otherwise. In addition, in describing the embodiment disclosed herein, when it is determined that detailed descriptions of related known technologies may obscure the gist of the embodiment disclosed herein, the detailed descriptions thereof will be omitted. In addition, it should be noted that the accompanying drawings are only for easy understanding of the embodiment disclosed herein, and do not limit the technical idea disclosed herein.

The features of various embodiments of the present disclosure can be partially or entirely coupled to or combined with each other and can be interlocked and operated in technically various ways, and the embodiments can be carried out independently of or in association with each other.

FIG. 2 shows a configuration of a laundry treating apparatus according to the present disclosure.

A laundry treating apparatus 1 according to an embodiment of the present disclosure may include a cabinet 10 that forms an outer appearance of the apparatus, a tub 20 disposed inside the cabinet, and a drum 30 that is rotatably accommodated inside the tub 20, and accommodates laundry (or an object-to-be-dried or an object-to-be-refreshed) therein.

The cabinet 10 may include an inlet 17 defined in a front surface of the cabinet 10 and through which the laundry (or the object-to-be-dried or the object-to-be-refreshed) is taken in and out. The cabinet 10 may include a door 16 pivotably mounted on the cabinet to open and close the inlet 17 of the cabinet 10.

The door 16 may be composed of an annular door frame 161 and a viewing window disposed at a central portion of the door frame.

The tub 20 is formed in a cylindrical shape with a longitudinal axis parallel to or maintaining an angle of 0° to 30° with a bottom surface of the cabinet to define a space in which water may be stored, and has a tub inlet 27 defined in a front surface thereof to be in communication with the inlet 17 of the cabinet 10.

The tub 20 may be supported by a support 70 and fixed inside the cabinet 10.

The support may include a damper 71 for supporting a bottom surface of the tub 20 and a spring 72 for supporting a top surface of the tub 20.

Accordingly, vibration transmitted to the tub 20 by rotation of the drum 30 may be attenuated.

The drum 30 is formed in a cylindrical shape with a longitudinal axis parallel to or maintaining an angle of 0° to 30° with the bottom surface of the cabinet to accommodate the laundry (or the object-to-be-dried or the object-to-be-refreshed) therein, and has a drum inlet 31 defined in a front surface thereof to be in communication with the tub inlet 27 (e.g., see FIG. 3).

Therefore, a user may put the laundry (or the object-to-be-dried or the object-to-be-refreshed) into an inner space of the drum 30 via the inlet 17 of the cabinet 10, the tub inlet 27, and the drum inlet 31, or withdraw the laundry (or the object-to-be-dried or the object-to-be-refreshed) from the inner space of the drum 30.

In addition, with reference to FIG. 3, the drum 30 may include a drum outer circumferential surface 32 for accommodating the laundry therein and a drum rear surface 33 disposed at the rear of the drum and coupled to a driver 40.

The drum outer circumferential surface 32 includes multiple through-holes or drainage holes defined therein. This is to allow water stored in the tub 20 to flow into the drum as well as to allow water discharged from the laundry (or the object-to-be-dried or the object-to-be-refreshed) to be discharged to an inner space of the tub 20 (e.g., to drain between the tub 20 and the drum 30).

A lifter 34 (e.g., one or more paddles) for stirring the laundry (or the object-to-be-dried or the object-to-be-refreshed) when the drum rotates may be further disposed on an inner circumferential surface of the drum 30.

The drum 30 may further include a balancer 35 coupled to the drum outer circumferential surface 32 from the front to compensate for eccentricity or an unbalanced load inside the drum 30.

A plurality of balls or fluid (e.g., a mass dampener) having a mass for compensating for the eccentricity may be accommodated inside the balancer 35.

The laundry treating apparatus 1 according to the present disclosure may include the driver 40 for rotating the drum 30.

The driver 40 may be coupled to the tub 20 to rotate the drum 30. The driver 40 may be composed of a stator 41 fixed to a rear surface of the tub 20 to generate a rotating magnetic field, a rotor 42 that rotates by an electromagnetic action with the stator 41, and a rotation shaft 43 that extends through the rear surface of the tub 20 and connects the drum rear surface 33 and the rotor 42 to each other.

In addition, the driver 40 may further include a spider 44 coupled to the drum rear surface 33 to rotate the drum 30.

The spider 44 may be configured as the rotation shaft 43 extends, and one surface thereof may be coupled to the drum rear surface 33 and may be coupled to the rotor 42 via the rotation shaft 43.

In one example, the laundry treating apparatus 1 according to one embodiment of the present disclosure may further include water supply means 50 for receiving water from the outside.

The water supply means 50 may include a water supply valve 51 coupled to the cabinet 10 and in communication with an external water supply source, a water supply pipe 52 extending from the water supply valve 51 and receiving water, a detergent box 53 that receives water from the water supply pipe 52 and stores detergent therein, and a supply pipe 54 that supplies at least one of water and detergent to the tub 20 by connecting the detergent box 53 and the tub 20 to each other.

The detergent contained in the detergent box 53 may be diluted with water introduced from the water supply pipe 52 and supplied to the tub 20 via the supply pipe 53.

The detergent box 53 may include a housing fixed in a space between the top surface of the tub 20 and the cabinet 10, and a detergent accommodating portion configured to be extended in a forward direction from and retracted into the housing.

The laundry treating apparatus according to one embodiment of the present disclosure may further include a drainage 60 that discharges water inside the tub 20 to the outside of the cabinet 10.

The drainage 60 may include a drain pipe 61 that discharges water from the tub 20, a drain pump 62 connected to the drain pipe 61 to provide power for discharging the water to the outside of the cabinet 10, and an extension pipe 63 extending from the drain pump 62 to the outside of the cabinet 10.

Preferably, the drain pump 62 and the drain pipe 61 are disposed below the tub 20 such that water in the tub 20 is more easily discharged by gravity.

In one example, a gasket 28 may be disposed between the inlet of the cabinet 10 and the tub inlet 27. The gasket 28 may prevent water inside the tub 20 from leaking into the cabinet 10.

In addition, the gasket 28 may be made of an elastic material to prevent vibration of the tub 20 from being transmitted to the cabinet 10.

The laundry treating apparatus 1 according to the present disclosure may include an input panel 11 for receiving a command to operate the laundry treating apparatus on a front surface thereof.

The input panel 11 may be configured to receive a series of commands for supplying power to the laundry treating apparatus or for the laundry treating apparatus to perform a washing course or a drying course for washing or drying the laundry.

The input panel 11 (e.g., user interface) may be formed as a user interface and may include display means such as a liquid crystal or a light to display information of the laundry treating apparatus.

The laundry treating apparatus according to the present disclosure may be configured to perform the heating of water, and drying and refreshing (steam treatment) of the laundry (or the object-to-be-dried or the object-to-be-refreshed).

To this end, the laundry treating apparatus 1 according to an embodiment of the present disclosure may include an induction module I for heating the drum 30.

The induction module I may be utilized when performing at least one function of washing, drying, and refreshing (e.g., a steaming operation).

The induction module I may be mounted on the outer circumferential surface of the tub 20 (e.g., see FIG. 3), and a coil 600 formed by winding an electric wire may be installed inside the induction module I. The induction module I serves to heat the circumferential surface of the drum 30 via a magnetic field generated by applying a current to the coil 600 (e.g., see FIG. 5).

When describing a scheme in which the induction module I heats the drum 30, an alternating current whose phase changes flows to the coil 600 located outwardly of the circumferential surface of the drum 30 and the coil 600 forms a radial alternating magnetic field based on the Ampere's circuital law. For example, a changing magnetic field can heat the metal drum 30 via eddy currents.

Such alternating magnetic field is concentrated around the drum 30 made of a conductor with high magnetic permeability. The magnetic permeability as used herein refers to an extent to which a medium is magnetized with respect to a given magnetic field. In this regard, based on the Faraday's law of induction, the eddy current is formed on the drum 30. Such eddy current flows along the drum 30 made of the conductor and then is converted into Joule heat by a resistance of the drum 30 itself, and accordingly, an inner wall of the drum 30 is directly heated.

When the inner wall of the drum 30 is directly heated, an air temperature inside the drum 30 and a temperature of the laundry in contact with the inner wall of the drum 30 rise together. Accordingly, because the laundry may be directly heated, drying may be performed faster compared to a drying apparatus using only a hot air drying scheme, which is an indirect heating scheme, or a low-temperature dehumidifying drying scheme.

In addition, even when the laundry treating apparatus according to an embodiment of the present disclosure is formed as the washing machine as well as the dryer, water may be heated even without a separate heating wire and flow channel exposed inside the tub 20, and water may continuously come into contact with the inner and outer walls of the drum 30. Therefore, faster water heating may be achieved compared to a scheme in which the separate heater is formed at a lower portion of the tub 20 and water is heated using the heater, and a complicated design can be avoided.

FIG. 3 shows an embodiment of the induction module I of the laundry treating apparatus according to an embodiment of the present disclosure.

The induction module I is mounted on the circumferential surface of the tub 20 and heats the circumferential surface of the drum 30 via the magnetic field generated by applying the current to the coil 600 around which the wire is wound.

The induction module I may include a base 100 for installing the coil 600 on a top surface of the tub 20. The base 100 may be fixed to the circumferential surface of the tub 20, and may extend over the rotation shaft 43 and be disposed on a horizontal surface parallel to the ground.

The base 100 may be formed in a rectangular plate shape or rectangular shape having a predetermined thickness, and a length in the front and rear direction thereof may be greater than a width corresponding to a circumferential direction of the tub 20.

The base 100 may include a base body 110 that may be disposed on the outer circumferential surface of the tub 20, a seating surface 120 disposed on a top surface of the base body 110 and on which the coil 600 is wound, a bottom surface 130 disposed on a bottom surface of the base body 110 and facing the outer circumferential surface of the tub 20, and a fixing portion 140 for coupling the base body 110 to the outer circumferential surface of the tub 20. Also, the base 100 may be formed in a rectangular plate shape that is slightly curved or rounded to correspond to a curved surface of the tub 20.

At least one of the base body 110 and the seating surface 120 may have a curved cross-section to concentrate a magnetic field generated from the coil 600 to the drum 30.

In addition, with reference to FIGS. 4 and 5, the base 100 may have seating ribs 200 protruding upward from the seating surface 120 and on which the coil is wound. The seating ribs 200 may extend outwardly from the seating surface 120 like a screw to define an installation space 230 in which the coil 600 is seated or inserted.

In order to concentrate the magnetic field generated by the coil 600 toward the drum 30 rather than the cabinet 10, the induction module I may include a permanent magnet 310 that is disposed on the base 100 and is a bar magnet, and a magnet cover 320 for fixing the permanent magnet 310 to the base 100 from above.

Multiple permanent magnets 310 may be arranged to be spaced apart from each other along a direction in which the coil 600 is wound. The permanent magnet 310 may be located above the coil 600, but may be disposed perpendicular to a longitudinal direction of the wire constituting the coil 600 to be simultaneously disposed above an inner portion and an outer portion of the coil.

The magnet cover 320 may further include a housing body 321 having a rectangular plate shape or rectangular shape with a predetermined thickness corresponding to the shape of the base 100, a magnet installation portion 322 defined on the housing body 321 and in which the permanent magnet 310 is seated, and an air flow hole 323 defined to extend through the housing body 321 and spaced apart from the magnet installation portion 322.

The magnet installation portion 322 may be defined to determine a space in which the permanent magnet 310 is accommodated and installed.

The induction module I may include a base cover 400 for fixing the magnet cover 320 to the base 100 and preventing the coil 600 from deviating.

The base cover 400 may include a cover body 410 having a rectangular plate shape or rectangular shape with a predetermined thickness, and an air discharge hole 420 defined in a central portion of the cover body 410 and through which hot air (air) flows by convection or in which a blowing fan is seated.

The blowing fan that supplies air into the induction module I may be coupled to the base cover 400. For example, the blowing fan can be positioned in or on air discharge hole 420.

The blowing fan allows air to flow into the induction module I to prevent overheating of the induction module I.

Specifically, air may be introduced into the base cover 400 via the air discharge hole 420. Inside the induction module, a space is defined between the base cover 400, a magnet coupling portion 300, and the base 100, and an air flow space is defined by an air flow hole 323 or the like. In addition, an air passing hole 111 is defined in the base body 110. Thus, air may cool the coil 600 in the inner space and may be discharged to the outside of the induction module via the air passing hole 111.

In addition, because the magnet cover 320 and the base cover 400 are formed as separate members, air may flow on a top surface of the permanent magnet 310. Thus, overheating of the permanent magnet 310 may be prevented.

In addition, because the magnet cover 320) and the base cover 400 are formed as the separate members, the permanent magnet 310 may be easily detachable, and thus, may be easily exchanged, and a part fixing the permanent magnet 310 may be easily injection-molded because of not having a closed surface.

Hereinafter, a structure for fixing the base 100, the magnet cover 320, and the base cover 400 to the tub 20 will be described.

First, the base 100 may include the fixing portion 140 disposed at a corner of the base body 110 and having a fixing hole defined therein into which the screw is inserted. The fixing portion 140 may be configured to protrude from each of both sides of front and rear ends of the base body 110. For example, the fixing portion 140 can be located at the four corners of the base 100, but embodiments are not limited thereto.

Multiple coupling portions 25 having a hollow portion in communication with the fixing hole in fixing portion 140 may be defined in the tub 20 (e.g., four mounting points on 20 as shown in FIG. 3).

In addition, the magnet cover 320 may include a magnet fixing portion 330 disposed at a corner of the housing body 321 and having a magnet fixing hole defined therein in communication with the fixing hole in fixing portion 140 and into which the screw is inserted.

The magnet fixing portion 330 may protrude from each of both sides of front and rear ends of the housing body 321 (e.g., at the four corners).

In addition, the base cover 400 may include a cover fixing portion 430 protruding from each of front and rear ends of the cover body 410 and having a cover fixing hole 431 defined there in communication with the fixing hole in fixing portion 140.

Accordingly, one screw may extend through the cover fixing hole 431—the magnet fixing hole 331—the fixing hole in fixing portion 140 and finally be fixed to the coupling portion 25.

FIG. 4 shows the base 100 of the induction module according to an embodiment of the present disclosure.

The induction module I may serve as a fixing member for fixing the coil 600 to the outer circumferential surface of the tub 20, and may include the base 100 mounted on the outer circumferential surface of the tub 20 such that the coil 600 does not deviate even when the tub 20 vibrates. The induction module I can also be referred to as an induction part I.

Part (a) in FIG. 4 shows a top surface of the base 100, and part (b) in FIG. 4 shows a bottom surface of the base 100.

Referring to part (a) in FIG. 4, the base 100 may include the base body 110 disposed on the outer circumferential surface of the tub 20, the seating surface 120 disposed such that the coil 600 is seated on the top surface of the base body 110, and the seating ribs 200 protruding from the seating surface 120 and fixed as the coil 600 is wound thereon.

The base body 110 may have the air passing hole 111 defined in a thickness direction.

The seating ribs 200 may extend to a top surface of the air passing hole 111. That is, the seating ribs 200 may be formed on the seating surface 120 regardless of a shape of the air passing hole 111.

The seating ribs 200 may extend outwardly along a circumference of the seating surface 120.

When extending outwardly, the seating ribs 200 may be spaced apart from each other by a certain spacing to define the installation space 230 in which the coil 600 is installed therebetween.

The seating ribs 200 may extend outwardly along a shape of a circle or an ellipse whose diameter gradually increases outwardly on the seating surface. In addition, the seating ribs 200 may extend in a track shape with an area increasing outwardly of the seating surface.

The track shape is a shape in which a straight portion and a curved portion are mixed with each other. The track shape may mean a shape capable of maximizing an area in which the coil 600 is seated of the seating surface 120 compared to the circular or elliptical shape.

A shape in which the coil 600 is wound may be determined based on the shape in which the seating ribs 200 extend from the seating surface 120.

The seating rib 200 may protrude or extend upwardly from the seating surface 120, and may have a height greater than a thickness of the coil 600).

The seating ribs 200 may allow turns of the wound coil 600 to be spaced apart from each other so as not to be in contact with each other, thereby preventing a short circuit. As a result, it is not necessary to coat the coil 600 wound on the seating ribs 200 with a separate insulating film or a thickness of the insulating film is able to be minimized, thereby reducing a production cost.

The seating ribs 200 may define slots or spaces between adjacent seating ribs that are narrower than a wire diameter of the coil 600 such that the coil 600 is tight-fitted or friction fitted, and a width of the installation space 230 may be in a range from 93% to 97% of the wire diameter of the coil 600.

When the coil 600 is tight-fitted into the installation space 230, even though the vibration of the tub 20 is transmitted to the coil 600, the coil 600 may be securely maintained fixed in the installation space 230. Therefore, the coil 600 does not depart from the installation space 230, and a movement of the coil 600 itself is suppressed, so that noise that may occur due to a gap may be prevented.

In one example, upper ends of the seating rib 200 may be bent after the coil 600 is inserted to shield at least a portion of a top portion of the coil 600. For example, each of the seating ribs 200 may a "T" shaped cross-section.

To this end, the upper ends of the seating ribs 200 may be bent or heat-treated.

Thus, the upper end of the seating rib 200 may form a fixing hook 221 for fixing the coil 600.

Referring to part (a) in FIG. 4, after the coil 600 is tight-fitted into the installation space 230, the seating rib 200 may be melted as a top surface thereof is pressurized. Then, the melted upper end of the molten seating rib 200 may spread to both sides to cover top surfaces of turns of the coil 600 on both sides. For example, after the coil 600 is installed, tops of the seating ribs 200 can be melted together to form a sealed surface that covers the coil 600.

As the coil 600 is tight-fitted into the installation space 230 and the upper end of the seating rib 200 is melted, a path along which the coil 600 may deviate may be physically blocked, and noise caused by the vibration of the tub 20 may be prevented by preventing the movement of the coil 600, and durability may be improved as a gap between parts is eliminated.

In the above description, it is assumed that the coil 600 is disposed on the top surface of the base 100, but the seating rib 200 may protrude downwardly of the base 100 such that the coil 600 is disposed on the bottom surface of the base 100.

Part (b) in FIG. 4 shows the bottom surface of base 100.

The air passing hole 111 may be exposed to the bottom surface 130 of the base 110.

In addition, referring to part (b) in FIG. 4, a support bar 131 may be disposed on the bottom surface of the base 110.

The support bar 131 may be configured to reinforce adhesion between the outer circumferential surface of the tub 20 and the base 100 and to reinforce rigidity of the base 100.

The base 100 may have a through-hole 112 defined at a center of the seating surface 120 where the coil 600 is not wound, and the through-hole 112 may include a plurality of through-holes spaced apart from each other by a predetermined spacing along the front and rear direction of the tub 20.

The support bar 131 may radially extend from the through-hole 112 extending through the base 100 (e.g., in a type of spoked configuration).

When the fixing portion 140 is fixed to the coupling portion 25 disposed on the outer circumferential surface of the tub 20, the outer circumferential surface of the tub 20 is pressurized by the support bar 131. Accordingly, the base 100 may be coupled to the tub 20 with a greater pressure compared to a situation in which the entire bottom surface of the base 100 is in contact with the outer circumferential surface of the tub 20. Accordingly, even when the tub 20 vibrates, the base 100 does not easily move or escape from the outer circumferential surface of the tub 20.

FIG. 5 shows a structure of the coil 600 of the induction module.

The seating ribs 200 may be formed from a position adjacent to an outermost edge of the seating surface 120 toward a center thereof, and each turn of the coil 600 may be wound between the adjacent two seating ribs 200.

Referring to a section A-A' in FIG. 5, the wire constituting the coil 600 may be tight-fitted by being in surface contact with the two adjacent seating ribs 200.

The laundry treating apparatus according to an embodiment of the present disclosure may include a control panel 15 that controls the supply of the current to the coil 600. Both ends of the coil 600 may be coupled to the control panel 15.

One end of the coil 600 may extend toward the through-hole defined at the center of the seating surface 120, and the other end thereof may extend on the seating surface 120 toward the outermost edge of the seating rib 200.

The coil 600 may extend from the control panel 15 toward the seating surface 120 via the bottom surface 130 of the base body 110, be wound on the seating ribs 200, and then be connected to the control panel 15.

In this regard, the coil wound on the seating ribs 200 may extend to the bottom surface 130 and then be connected to the control panel 15. This has an effect of preventing disconnection and deviation problems by reducing a vibration phase difference generated along a wire by allowing the coil 600 to be connected to the base 100 via the bottom surface, which is a point where a vibration displacement of the outer circumferential surface of the tub 20 is the smallest.

In one example, both ends of the coil 600 may extend to a rear portion of the tub 20 and extend to the control panel 15 (e.g., controller). This is a result of considering that an amplitude is small at the rear portion of the tub 20 because of being close to the driver 40 and thus more stable and secure.

FIG. 6 shows a detailed structure of the magnet cover 320.

The induction module I may further include the magnet cover 320 coupled to the base 100 to cover the installation space 230.

The magnet cover 320 may include a housing body 321 configured to be coupled to the top surface of the base 100 and preventing the coil 600 and the permanent magnet 310 from deviating or shaking loose.

A bottom surface of the housing body 321 may be formed to be in close contact with the upper ends of the seating ribs 200 of the base 100.

The plurality of magnet installation portions 322 protruding downwards may be defined on a bottom surface of the magnet cover 320.

The magnet installation portion 322 may provide a space for accommodating the permanent magnet 310 therein and, at the same time, may adhere closely to the upper end of the seating rib 320 to shield the seating rib 320 with a greater pressure.

As a result, despite the vibration of the tub 20, the noise caused by the gap or the deviation of the coil 600 may be prevented.

The plurality of magnet installation portions 322 may be arranged along the longitudinal direction of the coil 600. In addition, the magnet installation portion 322 may be formed perpendicular to the longitudinal direction of the coil 600. For example, the magnets can have a bar shape that can be disposed in a perpendicular direction relative to the windings of the coil 600. Therefore, the entire coil may be firmly fixed without pressing the entire coil.

In one example, the magnet installation portion 322 is preferably formed integrally with the housing body 321. Therefore, at the same time as the magnet cover 320 is coupled to the base 100, the magnet installation portion 322 presses the coil 600. Therefore, a separate means or step for pressurizing the coil 600 is not required.

The permanent magnet 310 may be inserted into and mounted in the magnet installation portion 322. Accordingly, when the permanent magnet 310 is fixed to the magnet cover 320, the permanent magnet may be fixed above the coil 600 as the magnet cover 320 is coupled to the base 100.

Because each permanent magnet 310 is preferably disposed at a specific position on the top surface of the coil 600 in order to efficiently concentrate the magnetic field in a direction of the drum 30, when the permanent magnet 310 moves by the vibration of the tub 20, not only the noise problem but also a problem of lowering a heating efficiency may occur.

More specifically, the magnet installation portion 322 may be formed of both side walls that protrude downward from the bottom surface of the magnet cover 320 and face each other, and may have an open surface 3221, such that a bottom surface of the permanent magnet 310 mounted in the magnet installation portion 322 may face one surface of the coil 600.

In this case, a movement of the permanent magnet 310 in a left and right direction may be suppressed by both of the side walls, and the open surface 3221 may allow the permanent magnet 310 to come closer to the top surface of the coil 600. In other words, four sides of the permanent magnet 310 can be surrounding by four side walls and a lower surface of the permanent magnet 310 can be covered by or overlapped with the top surface of the coil 600.

As the permanent magnet 310 is closer to the coil 600, the magnetic field is guided more intensively in the direction of the drum 30. As a result, the drum 30 may be stably and uniformly heated. For example, the open surface 3221 defined by the sides walls can allow the permanent magnet 310 to be located closer to the coil 600, which can improve heating efficiency.

The magnet installation portion 322 may further include a stopper protruding inward to prevent the permanent magnet 310 from deviating downward.

In one example, the magnet cover 320 may include detachable hooks 324 that protrude downward at both corners and are detachably coupled to the base 100.

FIG. 7 shows an arrangement of the coil 600 and the permanent magnet 310 installed in the induction module I.

The coil 600 may be formed in the concentric circle, ellipse, or track shape on the outer circumferential surface of the tub 20.

The permanent magnet 310 acts as a blocking member for transmission of the magnetic field to prevent the heating of other nearby components other than the drum 30, and to increase the heating efficiency by concentrating the magnetic field generated by the coil 600 in a direction toward the drum 30.

The permanent magnet 310 may be formed as the bar magnet. The permanent magnet 310 is located above the coil 600, but is preferably disposed perpendicular to the longitudinal direction of the coil 600. This is to cover the inner portion and the outer portion of the coil at the same time.

The permanent magnet 310 may include a plurality of bar magnets having the same size, and the plurality of permanent magnets 310 may be spaced apart from each other along the longitudinal direction of the coil 600.

This is because it difficult to perform the uniform heating as an amount of magnetic field radiated to the drum 30 varies for each portion of the circumferential surface of the drum 30 when the permanent magnets 310 are placed only at specific positions. Therefore, in order to uniformly induce the magnetic field generated by the coil 600 in the direction of the drum 30, it is preferable that the plurality of permanent magnets 310 are disposed to be spaced apart from each other along the circumference of the coil 600.

Furthermore, when there are the same number of permanent magnets 310, it is preferable that the permanent magnets 310 are intensively disposed or spaced closer together in portions of the coil 600 adjacent to front and rear portions of the tub 20.

Specifically, the coil 600 may be divided into first straight portions 610 extending in a front and rear direction, curved portions 620 disposed at both ends of the straight portion, and second straight portions 630 disposed at front and rear portions of the coil 600.

The first straight portion 610 may be longer than the second straight portion 630 to correspond to the length of the drum 30.

More permanent magnets may be disposed in the curved portion 620 and the second straight portion 630 than in the first straight portion 610. Also, the permanent magnets may be spaced closer together in the curved portion 620 and the second straight portion 630, than in the first straight portion 610. As a result, the drum 30 may be uniformly heated by allowing more magnetic field to be radiated to a region with a small area of the coil 600.

FIG. 8 shows a tub structure on which the induction module may be installed according to an embodiment of the present disclosure.

The tub body 21 has a cylindrical shape to accommodate the drum 30 therein.

Because the drum 30 is configured to rotate, the tub body 21 may be spaced apart from the drum outer circumferential surface 32 by a reference distance "a." That is, because the inner circumferential surface of the tub body 21 is spaced apart from the outer circumferential surface 32 of the drum by the reference distance "a," collision between the tub 20 and the drum 30 may be prevented even when the drum 30 rotates eccentrically or is unbalanced.

Because the drum 30 is coupled to the driver 40 by the spider 44 and the driver 40 is coupled to and fixed to a bearing housing disposed on the rear surface of the tub 20, even when the drum 30 rotates eccentrically to the maximum, a maximum value of an eccentricity width of the rotation shaft 43 is determined, so that a range of a maximum amplitude of the drum 30 is also determined.

Moreover, when the balancer 35 is disposed on the drum 30, the maximum amplitude of the drum 30 may be reduced.

In addition, the control panel 15 may be configured to stop driving the driver 40 when the drum 30 vibrates at an amplitude greater than the maximum amplitude.

As a result, the drum 30 may vibrate only within the expected maximum amplitude range. A distance at which the drum outer circumferential surface 32 may be closest to the tub body 21 when the drum 30 vibrates with the maximum amplitude may be set as a safety distance "b."

In other words, the drum 30 may be physically or controllably blocked from vibrating with an amplitude greater than the safety distance "b."

The reference distance "a" may be set greater than the safety distance "b" in consideration of a capacity of water accommodated in the tub, driving stability, and the like. As a result, the tub 20 may be disposed with a spacing greater than the safety distance "b" from the drum 30.

The drum 30 tends to rotate by being biased downwards due to its own load thereof and a weight of the laundry. An upper space inside the tub 20 may be less likely to collide with the drum 30 than a lower space inside the tub 20.

Based on the rotation shaft 44, the top surface of the tub body 21 may have a smaller spacing from the drum 30 than the bottom surface of the tub body 21.

In one example, the induction module I of the laundry treating apparatus according to an embodiment of the present disclosure may be coupled to the outer circumferential surface of the tub body 21. Because the drainage 60 is connected to the bottom surface of the tub body 21 and both side surfaces of the tub body 21 are disposed close to the cabinet 10, the induction module I may be coupled to the top surface of the tub body 21.

Because the induction module I generates the induced current in the drum 30 via an alternating current applied to the coil 600, the closer the induction module I is to the drum 30, the more advantageous it is.

In addition, the tub body 21 may include a mounting surface 22 on which the induction module I is installed or at least facing the induction module I, and a circumferential surface 23 extending from both side ends of the mounting surface 22 to form the outer circumferential surface of the tub body 21.

The mounting surface 22 of the outer circumferential surface of the tub body 21 may be disposed upwardly of the rotation shaft 44. For example, the mounting surface 22 can be located over a center axis of the rotation shaft 44, and the mounting surface can provide a flat or slanted surface for accommodating the induction module I. The mounting surface 22 can appear as a "shaved off" portion of the round tub body 21.

Taking all of these factors into consideration, the mounting surface 22 may be disposed closer to the drum 30 than the circumferential surface 23.

A spacing between the mounting surface 22 and the drum 30 may be smaller than a spacing between the circumferential surface 23 and the drum and 30.

To this end, the mounting surface 22 may extend in a plane from the circumferential surface 23 in a direction closer to the rotation shaft 44 or extend from one surface of the circumferential surface 23 to the other surface of the circumferential surface 23 to have a greater radius of curvature. For example, the mounting surface 22 can be a planarized portion of the circumferential surface 23 of the tub 20 (e.g., a notched portion, a shaved off portion, a cutout portion, etc.).

As a result, an entire region of the mounting surface 22 may have a distance away from the rotation shaft 44 that smaller than the distance from the rotation shaft 44 to the circumferential surface 23.

Accordingly, the induction module I may be disposed closer to the drum 30 than in the situation of being installed on the circumferential surface 23. For example, the mounting surface 22 can correspond to a planarized portion or a recessed portion of the circumferential surface 23 of the tub 20. In other words, mounting surface 22 can be a type of facet formed on or cut into a portion of the circumferential surface 23 of the tub 20.

A minimum spacing between the mounting surface 22 and the drum 30 may be equal to or greater than the safety distance "b."

FIG. 9 shows that the induction module I is installed on the mounting surface 22 according to an embodiment of the present disclosure.

The mounting surface 22 may have a width equal to or greater than that of the induction module I.

The mounting surface 22 may include a coupling portion 25 to which the induction module I is coupled.

The mounting surface 22 may have a greater radius of curvature than the circumferential surface 23 or be formed as a flat surface, and the base 100 of the induction module I may have a bottom surface 130 in surface contact with the mounting surface 22.

A seating surface 120 (e.g., upper surface) of the base 100 may have the same shape as the bottom surface 130 of the base 100, but embodiments are not limited thereto.

As a result, both the seating surface 120 and the bottom surface 130 may have a radius of curvature greater than that of the circumferential surface 23 or may be formed as a flat surface to be disposed closer to the drum 30 than the circumferential surface 23.

Therefore, the coil 600 wound on the seating surface 120 may also be disposed closer to the drum 30 than when the seating surface 120 is installed on the circumferential surface 23, so that more induced current may be generated in the drum 30.

FIG. 10, including parts (a) and (b), shows an embodiment in which an area of the mounting surface 22 may be secured as large as possible.

The larger the area of the mounting surface 22 is secured, the larger the area of the base 100 facing the mounting surface 22 may be secured, the larger the area of the coil 600 may be secured, and the smaller the spacing from the drum 30, so that performance and efficiency of the induction module I may be maximized.

Referring to part (a) in FIG. 10, the mounting surface 22 may have a greater radius of curvature than the circumferential surface 23 and thus may be located closer to the drum 30 than the circumferential surface 23. The mounting surface 22 may be disposed closer to the drum 30 as the radius of curvature thereof increases, and the mounting surface 22 may be disposed closest to the drum 30 when being formed as the flat surface with a radius of curvature of infinity.

In addition, the width of the mounting surface 22 may gradually increase as it is disposed closer to the drum 30.

As a result, the mounting surface 22 may be disposed close to the drum 30 such that the minimum distance between the mounting surface 22 and the drum 30 is the safety distance "b," and the width of the mounting surface at this time may correspond to a maximum width L1.

As a result, it may be considered that the mounting surface 22 has the maximum width L1 when the minimum distance between the mounting surface 22 and the drum 30 is equal to the safety distance b.

Referring to part (b) in FIG. 10, it is shown that the mounting surface 22 has an extended width L2 greater than the maximum width L1.

When the mounting surface 22 has a width greater than the maximum width L1, the mounting surface 22 extends to a portion of the circumferential surface 23 spaced farther apart, so that the minimum distance between the mounting surface 22 and the drum 30 is a collision distance "c" smaller than the safety distance "b."

Therefore, when the width of the mounting surface 22 is the extended width L2 that is greater than the maximum width L1, the width of the induction module I may be further extended. However, the minimum spacing between the mounting surface 22 and the drum 30 is the collision distance "c" smaller than the safety distance "b."

As a result, because a possibility of collision between the mounting surface 22 and the drum 30 increases, stability of the tub 20 and the induction module I may not be able to be secured.

Therefore, it may not be possible for the mounting surface 22 to have the width greater than the maximum width L1 because of a structure of the tub 20.

FIG. 11 shows a situation in which the induction module I is larger than the mounting surface 22.

As described above, the mounting surface 22 should not extend beyond the maximum width L1 because of the structures of the tub and drum.

However, in order to sufficiently heat the entire outer circumferential surface of the drum 30 to reach a desired heating performance, the induction module I should ensure that the number of windings or a width of the coil 600 is equal to or greater than the reference number or a reference width.

That is, a minimum width at which the induction module I heats the drum 30 and the laundry treating apparatus is able to perform at least one of the drying cycle and the hot water washing may be defined as a reference width.

However, because a diameter of the drum 30 should be secured to be equal to or greater than a certain diameter for securing a washing volume, the mounting surface 22 should extend beyond the maximum width L1.

As a result, the minimum width of the induction module I may be set greater than the maximum width L1 of the mounting surface.

Accordingly, the width of the base 100 of the induction module I is greater than the maximum width L1 of the mounting surface. A portion of the bottom surface 143 of the base 100 may face the mounting surface 22, and the remaining portion of the bottom surface 143 may face the circumferential surface 23. For example, portions of the base 100 of the induction module I may extend pass or overhang outer edges of the mounting surface 22 (e.g., see FIG. 11).

In addition, in the base 100, a portion of the seating surface 120 on which the coil 600 is wound may also be disposed to overlap with the mounting surface 22, while a remaining portion of the seating surface 120 may overlap with the circumferential surface 23.

In addition, the coupling portions 140 of the induction module I may be disposed on portions of the circumferential surface 23 disposed on both sides (e.g., opposite sides) of the mounting surface 22.

In one example, because the induction module I should be in close contact with the outer circumferential surface of the tub 22, the spacing between the induction module I and the drum 30 may be set to the smallest possible spacing given certain factors discussed above. Therefore, a portion of the bottom surface 130 of the induction module I may be in close contact with the mounting surface 22, while a remaining portion thereof may be in close contact with the circumferential surface 23.

In addition, a portion of the seating surface 120 of the induction module I may be in a shape (e.g., a flat shape) corresponding to the mounting surface 22, and the remaining portion thereof may be in a shape (e.g., a curved or rounded shape) corresponding to the circumferential surface 23.

As a result, both side surfaces (e.g., opposite ends) of the seating surface 120 may have a radius of curvature corresponding to that of the circumferential surface 23, and a center of the seating surface 120 may be formed as a flat surface corresponding to the mounting surface 22 or may have a greater radius of curvature than the circumferential surface 23.

As such, because the base 100 can be made of a plastic material such as reinforced resin, the shapes of the seating surface 120 and the bottom surface 130 may be easily changed according to design considerations.

However, because the coil 600 seated on the seating surface 120 and wound around the seating ribs 200 is formed as a metal tube such as wire, the coil 600 has its own elasticity, so that, when the radius of curvature of the seating surface 120 on which the coil 600 is wound and seated is changed, the coil 600 may not be able to be evenly seated on the seating surface 120.

In other words, a spring force applied to the coil 600 wound on a portion of the seating surface 120 corresponding to the circumferential surface 23 and a spring force applied to the coil 600 wound on a portion of the seating surface 120 corresponding to the mounting surface 22 may be different from each other. Accordingly, the coil 600 receives a force for deviating from the portion of the seating surface 120 corresponding to the circumferential surface 23 or a force for deviating from the portion of the seating surface 120 corresponding to the mounting surface 22, and thus installation stability of the coil 600 may be greatly reduced.

Therefore, in the laundry treating apparatus according to an embodiment of the present disclosure, when the width of the induction module I is greater than that of the mounting surface 22, the radius of curvature of the base 100 may be set to be greater than that of the circumferential surface 23 and smaller than that of the mounting surface 22. For example, the radius of curvature of the base 100, the radius of curvature of circumferential surface 23 of the tub and the radius of curvature of mounting surface 22 can all be different from each other.

Accordingly, the spacing between the coil 600 and the drum 30 may be optimally reduced while securing the installation stability of the coil 600 by keeping the radius of curvature of the seating surface 120 as uniform as possible over the entire width.

FIG. 12 shows a structure of the base 100 according to a preferred embodiment of the present disclosure.

A curvature of the circumferential surface 23 is the same as that of the tub outer circumferential surface 21. The curvature of the tub outer circumferential surface 21 may be smaller than that of the drum 30.

A spacing between the tub outer circumferential surface 21 or the circumferential surface 23 and the drum 30 may correspond to the reference distance "a."

As indicated by a dotted line, a curvature of the mounting surface 22 is smaller than the curvature of the tub outer circumferential surface 21. The mounting surface 22 may have a shape in which the tub outer circumferential surface 21 is recessed into a predetermined region of the circumferential surface 23 or may have a curved shape. For example, the mounting surface 22 can have a facet shape or a planarized shape that appears cut into or shaved off of the tub outer circumferential surface 21.

That is, the radius of curvature of the mounting surface 22 may be greater than the radius of curvature of the tub outer circumferential surface 21 or the circumferential surface 23. When the mounting surface 22 is formed in a shape of the flat surface, the radius of curvature of the mounting surface 22 may be infinite.

As a result, the minimum spacing between the mounting surface 22 and the drum 30 may correspond to the safety distance "b." The spacing between the mounting surface 22 and the drum 30 increases from a region of the mounting surface 22 corresponding to the safety distance "b" to a distal end of the mounting surface 22, so that a spacing between both ends of the mounting surface 22 and the drum 30 corresponds to the reference distance "a."

In one example, the base 100 should be coupled to the mounting surface 22, so that the spacing away from the drum 30 may be smaller than the reference distance "a" in an entire region.

However, when the width of the base 100 is greater than the width of the mounting surface 22, an average spacing between the base 100 and the drum 30 may be minimized only when the portion of the base 100 is in the shape corresponding to the mounting surface 22 and the remaining portion thereof is in the shape corresponding to the circumferential surface 23. For example, a middle section of the base 100 can have a flat shape, while opposite ends of the base 100 can be curved or rounded. However, according to an embodiment, a curvature of the seating surface 120 of the base 100 should be maintained as constant as possible or should not be changed suddenly so that the coil 600 is stably seated.

Therefore, it is desirable that the curvature of the seating surface 120 is maintained as constant as possible throughout an entire region of the seating surface 120. For example, the seating surface 120 may maintain a constant radius of curvature along an entire width or may be formed in a spherical shape.

Accordingly, the base 100 may have an induction curvature greater than the curvature of the mounting surface 22 and smaller than the curvature of the circumferential surface 23 in consideration of the curvatures of the mounting surface 22 and the circumferential surface 23.

As a result, the curvature of the seating surface 120 of the base 100 may be smaller than the curvature of the circumferential surface 23.

Then, a distance between the drum 30 and the portion of the base 100 corresponding to the mounting surface 22 reaches a reduced distance "d" at which the portion of the base 100 is closer to the drum 30 than the tub outer circumferential surface 21, and the portion of the base 100 corresponding to the circumferential surface 23 is farther away from the drum 30 than the tub outer circumferential surface 21 and is spaced apart from the drum 30 by a distance equal to or greater than the reference distance "a."

However, because the region of the base 100 facing the mounting surface 22 is much larger than the region thereof facing the circumferential surface 23, the average spacing between the base 100 or the seating surface 120 and the drum 30 may be set smaller than the reference spacing "a."

As a result, the base 100 may be installed much closer to the drum 30 than the tub outer circumferential surface 21 while stably installing the coil 600 having the greater width than the mounting surface 22.

Therefore, the seating surface 120 may be disposed at a position optimally close to the drum 30, so that an average spacing between the coil 600 and the drum 30 may be optimally set and the coil 600 can be located as close as possible to the drum 30.

FIG. 13 shows a shape of the base 100 according to an embodiment of the present disclosure.

In the laundry treating apparatus 1 according to embodiments of the present disclosure (e.g., FIG. 2), it may be seen that the tub 20 and the drum 30 are arranged while forming concentric circles based on the rotation shaft 44.

The drum 30 has a drum diameter D1 and has a radius of curvature corresponding to the drum diameter D1, and the tub 20 has a tub diameter T1 greater than the drum diameter and has a radius of curvature corresponding to the tub diameter T1.

As a result, the radius of curvature of the circumferential surface 23 may be the tub diameter T1, and the radius of curvature of the mounting surface 22 may be greater than the tub diameter T1.

In one example, the seating surface 120 of the induction module I has the greater width than the mounting surface 22 and is coupled to the circumferential surface 23.

That is, a portion of the seating surface 120 is disposed to face the mounting surface 22, while a remaining portion thereof is disposed to face the circumferential surface 23.

In this regard, when the radius of curvature of the seating surface 120 changes or the seating surface 120 has the shape of the mounting surface 22 and the circumferential surface 23, the coil 600 wound on the seating surface 120 may not be wound, or even when the coil 600 is wound, the spring force of the coil 600 may be different in each section, so that the coil 600 may deviate from the seating surface 120 or it may be difficult to fix the coil 600 to the seating surface 120.

Therefore, it is preferable that the radius of curvature of the seating surface 120 is as constant as possible along the entire width of the induction module I.

In this regard, the radius of curvature of the circumferential surface 23 is equal to the radius of curvature T1 of the tub, and the radius of curvature of the mounting surface 22 is infinite or greater than the radius of curvature T1 of the tub.

In this regard, in order for the seating surface 120 to maintain the constant radius of curvature as much as possible while being disposed closer to the drum because of the mounting surface 22, a radius of curvature I1 of the seating surface 120 may be greater than the drum radius of curvature D1 and greater than the radius of curvature of the circumferential surface 23 or the radius of curvature T1 of the tub (e.g., I1>T1>D1).

However, the radius of curvature I1 of the seating surface 120 may be smaller than the radius of curvature of the mounting surface 22.

Accordingly, a reference point IO of the radius of curvature I1 of the seating surface 120 may be disposed lower than the rotation shaft 44.

The radius of curvature of the seating surface 120 may be defined as an induction radius of curvature I1.

As a result, the induction module I may be disposed inwardly of the outer circumferential surface 21 of the tub in the region facing the mounting surface 22, and the average spacing between the induction module I and the drum 30 may also be reduced to be smaller than the reference distance a between the outer circumferential surface 21 of the tub and the drum 30.

In one example, the seating surface 120 may be disposed parallel to the mounting surface 22. For example, the seating surface 120 may be formed as a flat seating surface 120*a* to be in surface contact with the mounting surface 22.

The flat seating surface 120*a* may have an equal projection area toward the drum 30 as the seating surface 120. In other words, an area of the flat seating surface 120*a* may be equal to an actual area of the seating surface 120 facing the drum 30.

Therefore, the coil 600 wound on the flat seating surface 120*a* may radiate the same magnetic field to the drum 30 as the coil 600 wound on the seating surface 120.

Because the flat seating surface 120*a* is in a shape that is parallel to the mounting surface 22, the flat seating surface 120*a* may be disposed closer to the mounting surface 22 than the seating surface 120 or may be brought into close contact with the mounting surface 22. For example, the flat seating surface 120*a* and the mounting surface 22 can be two parallel flat planes.

Accordingly, a portion of the flat seating surface 120*a* facing the mounting surface 22 may be disposed to be spaced apart from the drum 30 by the safety distance "b," which is smaller than the reduced distance "d," which is the distance between the seating surface 120 and the drum 30.

As a result, the coil 600 wound on the portion of the flat seating surface 120*a* facing the mounting surface 22 may be disposed closer to the drum 30 to generate a stronger induced current in the drum 30 which can also reduce power consumption.

However, because the radius of curvature of the drum 30 is smaller than the radius of curvature of the circumferential surface 23, the portion of the flat seating surface 120*a* facing the circumferential surface 23 is farther away from the drum 30 than the circumferential surface 23.

In other words, an outer portion of the portion facing the mounting surface 22 of the flat seating surface 120*a* is spaced apart from the drum 30 by a distance much greater than the reference distance "a," and the spacing increases exponentially based on the curvature of the drum 30 from the portion of the flat seating surface 120*a* facing the mounting surface 22 to an outer surface thereof facing the circumferential surface 23. Accordingly, the coil 600 wound on a region of the flat seating surface 120*a* facing the circumferential surface 23 inevitably generates a very weak induced current in the drum 30.

Because the seating surface 120 has the induction radius of curvature I1 greater than the radius of curvature of the tub in the entire region, the seating surface 120 may be spaced apart from the mounting surface 22 in a region facing the mounting surface 22. Accordingly, the region of the seating surface 120 facing the mounting surface 22 may be spaced apart from the drum 30 by a distance greater than the safety distance "b," which may be disadvantageous compared to the flat seating surface 120*a*.

However, a region of the seating surface 120 facing the circumferential surface 23 is bent in a direction closer to the drum 30 based on the induction radius of curvature I1.

As a result, in a direction from the region facing the mounting surface 22 of the seating surface 120 to an outer surface of the region facing the mounting surface 23 of the seating surface 120, the distance from the drum 30 may become much smaller than the distance between the flat seating surface 120*a* and the drum 30.

As a result, an average value of the induced current values generated in the drum 30 by the flat seating surface 120*a* or a sum of the induced power generated in the entire drum 30 by the flat seating surface 120*a* is smaller than an average value of the induced current values generated in the drum 30 by the seating surface 120 or a sum of induced powers generated in the entire drum 30 by the seating surface 120.

Therefore, it is advantageous that more induced power may be generated in the drum 30 when the base 100 is formed as the seating surface 120 rather than as the flat seating surface 120*a*. This may also be seen in detail in an experimental result in FIG. 15.

FIG. 14 shows another embodiment of the base 100 according to an embodiment of the present disclosure.

In a cross-section of the base 100, the seating ribs 200 are disposed on the seating surface 120.

As described above, the radius of curvature of the seating surface 120 should be kept constant in consideration of the stable winding of the coil 600, but the bottom surface 130 does not need to have a constant radius of curvature.

Furthermore, as the bottom surface 130 is in surface contact with the tub outer circumferential surface 21 or comes into close contact with the tub outer circumferential surface 21, stability of the base 100 may be increased and the coil 600 may be placed closer to the drum 30, and vibrations and noise can be minimized or prevented.

Therefore, the bottom surface 130 may have a different radius of curvature from the seating surface 120.

Specifically, the radius of curvature of the bottom surface 130 may be smaller than the radius of curvature of the seating surface 120. For example, the radius of curvature of the bottom surface 130 may be a radius of curvature corresponding to the radius of curvature of the tub outer circumferential surface 21.

Alternatively, a region of the bottom surface 130 facing the mounting surface 22 may be in a shape corresponding to the mounting surface 22, and a region thereof facing the circumferential surface 23 may be in a shape corresponding to the circumferential surface 23. For example, the bottom surface 130 may have both the flat surface and a curved surface, which can match the notched portion and curved portions of the tub 20.

Accordingly, the bottom surface 130 may be in surface contact with the tub 20 or may be disposed parallel to the tub 20, so that the base 100 may be stably coupled to the tub 20.

As a result, because the base 100 may be made of the plastic material, and it may be easy to form the shape of the base 100 to match the shape of the tub 20, and the shape of the bottom surface 130 may be set differently from the shape of the seating surface 120.

Therefore, the seating surface 120 may be designed to have the induction radius of curvature I1 and the bottom surface 130 may be manufactured based on the shape of the facing tub outer circumferential surface 21, thereby improving the installation stability of the base 100.

FIG. 15 shows an effect of an induction module of a laundry treating apparatus according to an embodiment of the present disclosure.

The heating performance of the induction module may be determined by the spacing between the coil 600 and the drum 30 when the area of the coil 600 is the same.

Therefore, it may be seen that the smaller the spacing between the induction module and the drum 30 is, the better the heating performance of the induction module I is.

Referring to FIG. 15, assuming that a plurality of induction modules are manufactured to have the same width or area, a change in the spacing in a direction away from the drum from the center of the induction module to the outer surface of the induction module may be identified for each of a case in which the induction module has a simple flat surface (a straight line), a case in which the induction module has the same radius of curvature as the tub outer circumferential surface 21 (a double dashed line), and a case in which the tub outer circumferential surface 21 has the mounting surface 22 and the radius of curvature of the induction module is greater than the radius of curvature of the tub outer circumferential surface 21 (a thick dotted line).

When the tub has the mounting surface 22 and the induction module extends as the simple flat surface at the safety distance "b" from the drum 30, a region of the induction module corresponding to the safety distance "b" may be closest to the drum 30. However, because the induction module is formed as the flat surface and the drum has the circular shape, the spacing from the drum 30 increases exponentially in a direction closer to the side surface of the induction module.

Therefore, when the induction module extends as the flat surface at the safety distance "b." because the average distance between the induction module and the drum increases, it may be disadvantageous in terms of the heating performance.

In one example, there may be a case in which the tub has no mounting surface 22 and has only the circumferential surface 23, and the induction module has the same radius of curvature as the tub outer circumferential surface, which is the same as the related art example laundry treating apparatus. In this case, when the induction module is coupled to the tub outer circumferential surface, the induction module may be spaced apart from the drum 30 by a distance equal to or greater than the reference distance "a." Therefore, the average distance between the induction module and the drum may be set to be greater than that in the case in which the induction module is formed in the flat surface shape.

As a result, it may be seen that the heating performance is the lowest when the tub is formed as the simple circumferential surface without the mounting surface and the induction module is coupled to the outer circumferential surface of the tub.

As in the induction module of the laundry treating apparatus according to the present disclosure, when the tub has the mounting surface 22 and the radius of curvature of the induction module is greater than the radius of curvature of the tub, in the entire region of the induction module I, the spacing from the drum 30 is greater than the safety distance "b."

However, it may be seen that the spacing from the drum 30 does not greatly increase in the direction closer to the side surface of the induction module I.

Therefore, it may be seen that the average spacing between the entire region of the induction module I and the drum 30 is set smaller than that in the case in which the induction module is formed as the flat surface and has the radius of curvature corresponding to the radius of curvature of the tub.

As a result, it may be seen that the induction module I having the radius of curvature greater than that of the outer circumferential surface of the tub has the highest heating performance, and a heating performance is higher than that of the related art example laundry treating apparatus even when the outer circumferential surface of the tub has the mounting surface and the induction module is simply coupled to the mounting surface.

FIG. 16, including parts (a) and (b), shows a laundry treating apparatus according to another embodiment of the present disclosure.

Referring to part (a) in FIG. 16, the tub body 21 may be formed as a first tub body 211 having the inlet 27 defined therein and a second tub body 212 to which the driver 40 is coupled are coupled to each other.

A diameter of the first tub body 211 may increase from the inlet toward the second tub body 212, and a diameter of the second tub body 212 may decrease from the first tub body 211 to the driver 40.

However, because the mounting surface 22 should be formed such that the spacing from the drum 30 is maintained constant, the mounting surface 22 may be disposed in parallel with the outer circumferential surface of the drum.

Accordingly, when the mounting surface 22 is disposed on the tub outer circumferential surface 21, the first tub body 211 may gradually increase in width in a rearward direction, and the second tub body 212 may gradually decrease in width in the rearward direction.

Referring to part (b) in FIG. 16, the induction module I may have a width greater than that of the mounting surface 22. Accordingly, the fixing portions 25 may be disposed on the circumferential surfaces 23 spaced apart from both sides of the mounting surface 22, and the coupling portion 140 may be coupled to the fixing portion 25.

Thus, a portion of the induction module I may be disposed to face the mounting surface 22 and the remaining portion thereof may be disposed to face the circumferential surface 23.

The present disclosure may be implemented in various forms, so that the scope of the rights thereof is not limited to the above-described embodiment. Therefore, when the modified embodiment includes components of claims of the present disclosure, it should be regarded as belonging to the scope of the present disclosure.

The invention claimed is:

1. A laundry treating apparatus comprising:

a cabinet including an inlet;

a tub disposed inside the cabinet, the tub being configured to hold water;

a drum disposed inside the tub, the drum including a conductive material and being configured to rotate;

a driver including a rotation shaft, the driver being disposed at a rear of the tub and being configured to rotate the drum; and an induction module coupled to an outer circumferential surface of the tub, the induction module being configured to generate a magnetic field for heating the drum, wherein the tub includes a mounting surface, wherein the induction module either is mounted on the mounting surface or overlaps with the mounting surface, wherein the mounting surface either is a flat surface or has a radius of curvature that is greater than a radius of curvature of the tub, wherein the tub has a cylindrical shape having a diameter that increases and then decreases in a rearward direction of the cabinet, and wherein the mounting surface is spaced apart from the drum by a spacing distance that remains constant from a front end of the mounting surface to a rear end of the mounting surface.

2. The laundry treating apparatus of claim 1, wherein the mounting surface is disposed over the rotation shaft or the drum.

3. The laundry treating apparatus of claim 1, wherein the mounting surface faces a top panel of the cabinet.

4. The laundry treating apparatus of claim 1, wherein a width of the mounting surface increases and then decreases in the rearward direction.

5. The laundry treating apparatus of claim 1, wherein the tub includes a circumferential surface extending from the mounting surface to form the outer circumferential surface of the tub, and wherein the mounting surface is spaced apart from the drum by a spacing distance that is smaller than a distance between the circumferential surface of the tub and the drum.

6. The laundry treating apparatus of claim 5, wherein a distance from the rotation shaft to the mounting surface is smaller than a distance from the rotation shaft to the circumferential surface of the tub.

7. A laundry treating apparatus comprising:

a cabinet including an inlet;

a tub disposed inside the cabinet, the tub being configured to hold water;

a drum disposed inside the tub, the drum including a conductive material and being configured to rotate;

a driver including a rotation shaft, the driver being disposed at a rear of the tub and being configured to rotate the drum; and an induction module coupled to an outer circumferential surface of the tub, the induction module being configured to generate a magnetic field for heating the drum, wherein the tub includes a mounting surface, wherein the induction module either is mounted on the mounting surface or overlaps with the mounting surface, wherein the mounting surface either is a flat surface or has a radius of curvature that is greater than a radius of curvature of the tub, wherein a width of the induction module is greater than a width of the mounting surface, or an area of the induction module is greater than an area of the mounting surface, and wherein the induction module includes:

a base configured to support a coil for generating the magnetic field; and a coupling portion extending from the base, the coupling portion being fixed to the tub, and wherein the coupling portion is spaced apart from the mounting surface.

8. The laundry treating apparatus of claim 7, wherein a radius of curvature of the base is greater than the radius of curvature of the tub.

9. The laundry treating apparatus of claim 7, wherein a radius of curvature of the base is smaller than the radius of curvature of the mounting surface.

10. The laundry treating apparatus of claim 7, wherein at least a portion of the base is spaced apart from the mounting surface.

11. The laundry treating apparatus of claim 7, wherein a radius of curvature of the base remains constant along a width of the base.

12. The laundry treating apparatus of claim 7, wherein the base includes:

a seating surface on which the coil is seated; and a bottom surface opposite to the seating surface, the bottom surface facing the mounting surface, and wherein a radius of curvature of the seating surface is greater than the radius of curvature of the tub.

13. The laundry treating apparatus of claim 12, wherein a radius of curvature of the bottom surface of the base is different than the radius of curvature of the seating surface of the base.

14. The laundry treating apparatus of claim 13, wherein the radius of curvature of the bottom surface is greater than the radius of curvature of the seating surface, or wherein the bottom surface is a flat surface.

15. The laundry treating apparatus of claim 14, wherein a shape of the bottom surface corresponds to the mounting surface and a portion of the outer circumferential surface of the tub that is adjacent to the mounting surface.

16. The laundry treating apparatus of claim 7, wherein the width of the induction module is greater than the width of the mounting surface, and wherein a length of the induction module is smaller than a length of the mounting surface.

17. A laundry treating apparatus comprising:

a cabinet including an inlet;

a cylindrical shaped tub disposed inside the cabinet, the cylindrical shaped tub being configured to hold water;

a drum disposed inside the cylindrical shaped tub, the drum including a conductive material and being configured to rotate; and an induction module overlapping with a mounting surface of the cylindrical shaped tub, the induction module being configured to generate a magnetic field for heating the drum, wherein the mounting surface is a planarized portion of the cylindrical shaped tub or a recessed portion of the cylindrical shaped tub, wherein the induction module includes:

a base having a bottom surface that faces toward the cylindrical shaped tub and a top surface that is opposite to the bottom surface, and a coil disposed on the top surface of the base, and wherein a radius of curvature of the top surface of the base is greater than a radius of curvature of an outermost circumferential surface of the cylindrical shaped tub.

18. The laundry treating apparatus of claim 17, wherein a center of the mounting surface is closer to a center of the cylindrical shaped tub than to an outermost circumferential surface of the cylindrical shaped tub.

19. The laundry treating apparatus of claim 17, wherein a radius of curvature of the bottom surface of the base is different than the radius of curvature of the top surface of the base.

20. The laundry treating apparatus of claim 17, wherein a portion of the induction module extends past an outer edge of the mounting surface of the cylindrical shaped tub.

* * * * *